US009239141B1

(12) United States Patent
Schertler

(10) Patent No.: US 9,239,141 B1
(45) Date of Patent: Jan. 19, 2016

(54) OPTICAL ELEMENT PROVIDING OBLIQUE ILLUMINATION AND APPARATUSES USING SAME

(71) Applicant: RPC PHOTONICS, INC., Rochester, NY (US)

(72) Inventor: Donald J. Schertler, Rochester, NY (US)

(73) Assignee: RPC PHOTONICS, INC., Rochester, NY (US)

( * ) Notice: Subject to any disclaimer, the term of this patent is extended or adjusted under 35 U.S.C. 154(b) by 194 days.

(21) Appl. No.: 13/968,998

(22) Filed: Aug. 16, 2013

Related U.S. Application Data

(63) Continuation-in-part of application No. 13/768,746, filed on Feb. 15, 2013.

(51) Int. Cl.

| | |
|---|---|
| ***F21V 5/00*** | (2015.01) |
| ***F21V 7/04*** | (2006.01) |
| ***F21K 99/00*** | (2010.01) |
| ***G09F 13/02*** | (2006.01) |
| ***F21V 7/00*** | (2006.01) |

(52) U.S. Cl.
CPC ..... *F21K 99/00* (2013.01); *F21V 5/007* (2013.01); *F21V 7/0091* (2013.01); *G09F 13/02* (2013.01)

(58) Field of Classification Search
CPC ..... F21V 5/007; F21V 7/0091; F21K 99/00; G09F 13/02
USPC ..... 362/242, 243
See application file for complete search history.

(56) References Cited

U.S. PATENT DOCUMENTS

| | | | | |
|---|---|---|---|---|
| 4,188,657 | A | 2/1980 | Reibling | |
| 4,843,527 | A * | 6/1989 | Britt | 362/231 |
| 4,954,935 | A | 9/1990 | Hammond et al. | |
| 5,951,150 | A * | 9/1999 | Helstern | 362/293 |
| 6,481,130 | B1 | 11/2002 | Wu | |
| 6,497,500 | B1 | 12/2002 | Bradford | |
| 6,773,135 | B1 | 8/2004 | Packer | |
| 6,837,605 | B2 | 1/2005 | Reill | |
| 6,918,684 | B2 | 7/2005 | Harvey | |
| 6,976,765 | B2 | 12/2005 | Helenowski | |
| 7,033,736 | B2 | 4/2006 | Morris et al. | |
| 7,377,672 | B2 | 5/2008 | Tickner | |
| D580,565 | S | 11/2008 | Wilkinson | |
| D582,581 | S | 12/2008 | Wilkinson | |
| 7,481,557 | B2 | 1/2009 | Gaines et al. | |
| 7,726,847 | B2 | 6/2010 | Bingaman | |
| 7,896,522 | B2 | 3/2011 | Heller et al. | |

(Continued)

*Primary Examiner* — Alan Cariaso
(74) *Attorney, Agent, or Firm* — Kenneth J. Lukacher Law Group

(57) ABSTRACT

An optical element is provided having an asymmetric body, a light source, and a front face tilted at an oblique angle with respect to a target surface to provide illumination that is at least substantially uniform along the target surface's height. One or more optical elements may be in an apparatus, and multiple apparatuses may be disposed in front of one edge of a target surface to provide thereto at least substantially uniform oblique illumination. When the light source is an LED that is spectrally non-uniform at increasing angles away from its optical axis, the optical elements having such LEDs provide illumination that is spectrally non-uniform along a portion of the target surface, and additional optical elements with LED light sources are provided having a spectrum in one or more spectral ranges that compensates for such spectral non-uniformity to correct spectral non-uniformity along such portion of the target surface.

30 Claims, 20 Drawing Sheets

(56) References Cited

U.S. PATENT DOCUMENTS

| | | | | |
|---|---|---|---|---|
| 7,959,326 | B2 | 6/2011 | Laporte | |
| D673,719 | S | 1/2013 | Yeh | |
| 8,459,845 | B2 | 6/2013 | Chang | |
| 8,777,458 | B2 | 7/2014 | Seki et al. | |
| 2005/0195603 | A1* | 9/2005 | Hulse | 362/246 |

* cited by examiner

OPTICAL ELEMENT PROVIDING OBLIQUE ILLUMINATION AND APPARATUSES USING SAME

CROSS-RELATED APPLICATIONS

This application is a continuation-in-part of U.S. patent application Ser. No. 13/768,746, titled "Optical Element Providing Oblique Illumination And Apparatuses Using Same", filed on Feb. 15, 2013, the entire contents of which are incorporated herein by reference.

FIELD OF THE INVENTION

The invention relates to an optical element that illuminates a surface at an oblique angle and does so such that the irradiance of the surface is uniform at least substantially over an area (e.g., height and at least a portion of width) of that surface, and apparatuses having optical element and source(s) providing illumination thereto. The optical element of the present invention is useful for applications such as illumination of a wall from a floor or ceiling position, architectural lighting, sign or billboard lighting, or any other application where the light source is not positioned directly in front of the object being illuminated but must be located at an oblique angle to the surface or object to avoid obstructing the view of the surface. The optical element may utilize an LED light source, but similar small sources may also be used. Array(s) of optical elements may be provided for illuminating a surface, such as a billboard. When optical elements of the present invention utilize LED light sources having a color shift with emission angle causing spectral non-uniformity, a portion of the surface illuminated by such optical elements will be spectrally non-uniform with the rest of the surface. To correct this, additional optical elements are provided directing light to such portion with LED light sources of a spectrum in one or more spectral regions that compensates for the spectral non-uniformity, so that such portion is spectrally uniform with the rest of the illuminated surface.

BACKGROUND OF THE INVENTION

Typically, illumination of a roadside billboard sign is provided, for example, by 2 to 4 high-power metal halide lamps placed in separate fixtures at the base of the billboard sign a few feet out and pointed upward towards the board which may be 15 to 20 feet high and 40 feet or more wide. The lamp fixtures are typically separated from one another by ten to twelve feet. The resulting light distribution on the billboard (irradiance, or power per unit area) is poor and can vary by 6:1 or more, and will often exhibit an undesirable scalloped pattern at the base where, directly in front of the lights, the billboard is most brightly lit and between the lights the billboard is poorly lit. In addition, the irradiance along the height of the billboard is not uniform, decreasing significantly from the bottom to the top of the billboard.

Current billboard lighting systems utilizing a metal halide lamp have a reflector surrounding the backside of the lamp, and a window enclosing the unit. See, for example, U.S. Pat. No. 6,773,135 to Packer, and U.S. Pat. No. 4,954,935 to Hammond et al. Light from the lamp can take two paths before striking the billboard or vertical surface. The first is the direct path from the lamp, through the window to the billboard. The second is the reflected path in which light leaves the lamp, strikes the reflector, exits the window, and then strikes the billboard. In both Packer and Hammond et al. the window consists of a smooth area directly in front of the lamp, and a refractive prismatic-like structure along the periphery of the window. The refractive portion of the window captures some of the direct-path light and bends it toward the billboard. This light would otherwise miss the billboard if it were not refracted and bent by the prismatic structures of the window.

The reflector reflects the reflected-path light from the lamp and distributes it in a controlled fashion across a pre-defined region of the billboard. This may be done by faceting or shaping the reflector. The reflected-path light exits the fixture through the smooth area in the center portion of the window.

The center portion of the window is left smooth so as not to alter the path of the reflected light. But in doing so, the direct light passing through this center portion remains uncontrolled. This presents a problem. In general it is best to control all the light emitted from the lamp, both the direct-path light and reflected-path light to obtain the desired uniformity and light distribution across the billboard or vertical panel. Each point on the window passes both direct light and reflected light. If one tries to control the direct light by manipulating the structure of the center portion of the window, then one adversely affects the path of the reflected light. Conversely, if one tries to alter the path of the reflected light by manipulating the structure of the center portion of the window, then the direct light is adversely affected. Both paths cannot be controlled by the same structure. Although attempts have been made to control the reflected light by structuring the reflector and having a clear window, this allows much of the direct light to strike the billboard uncontrolled or even miss the billboard surface altogether, the consequence of this is that uniformity of the light distribution on the billboard is degraded. It has been found that currently used metal halide lamp systems despite such attempts have poor uniformity of a 6 to 1 variation of the light irradiance across the billboard. Thus, improved lighting apparatuses are needed to overcome the above problem and provide better uniformity of illumination over the entire area of a billboard, or other vertical surface requiring uniform oblique illumination to avoid obstructing the view of such surface from at least the front thereof.

Concerns about efficiency, light pollution, and other factors have manufacturers seeking alternatives to the current high intensity discharge (HID) lamps, such as LEDs. U.S. Pat. No. 7,896,522 to Heller et al. describes a front illuminated billboard using a linear array of LEDs stretching across the entire bottom of a panel to be illuminated. Some of the LEDs are fitted with lenses that are to illuminate a "top" area, others with different lenses to illuminate the "middle" and others that act as "fillers" which may or may not have lenses. The lenses are not designed for the oblique illumination of a billboard or vertical surface. Although useful to improve the overall efficiency for illumination of a billboard from that of HID lamps, the uniformity of this approach is even poorer in that the irradiance along the billboard varies from 12.6 footcandles to 99 footcandles, as stated by Heller et al., or a variation of nearly 8 to 1. It would thus be desirable to provide improved lighting apparatuses that cannot only provide more uniformity of illumination of a billboard, or similar vertical surface, of better then 8:1, preferably better than 6:1, and more preferably better than 3:1, but can utilize LED(s) rather than the typically used HID lamps.

In addition to the uniformity of illumination irradiance, it is typically desired that the color of the illumination be uniform over the region that is illuminated which can be difficult when illuminating with LEDs that exhibit a color shift with emission angle, such as in the case of "white" light sources that utilize a phosphor with a short-wavelength die to cause a broad spectrum of light to be emitted. Examples of such LEDs are the XM-L high brightness LED from CREE in warm, neutral and cool white, the Nichia 119A white LED, the Samsun LM516B white LED, and the Luxeon Rebel. Thus, it would further be desirable to provide improved lighting apparatuses utilizing LED(s) that cannot only provide more uniformity of illumination of a billboard, or similar vertical surface, but which also can correct for such color shift when present.

SUMMARY OF THE INVENTION

Accordingly, it is an object of the present invention to provide an optical element to provide improved oblique illumination of a surface, such as a billboard, or other vertical surface, having more uniformity than the prior art.

It is a further object of the present invention to provide an optical element and using same to provide oblique illumination of a surface using small light source(s), such as LED(s).

It is another object of the present invention to provide an optical element that can be used in apparatuses having one or more optical elements that are positionable along the width of a surface, spaced horizontally and vertically from the bottom, top, or side edge thereof, to provide oblique angle illumination which is at least substantially uniform in irradiance from upwards, downwards, or sideways, respectively, so as to appear uniform in illumination to human visual perception of such surface.

A still further object of the present invention is to provide an optical element that can be used in apparatuses having multiple optical elements that utilize LEDs to provide oblique illumination which is uniform (at least substantially) in spectrum (or color) along a surface so as to appear uniform in spectrum (or color) to human visual perception of such surface.

Another object of the present invention is to provide an apparatus with optical elements utilizing LED light sources to provide oblique illumination to a surface in which when such LED light sources have an undesirable shift in their color with emission angle causing spectral non-uniformity along a surface, additional optical elements can be provided with LED light sources to illuminate the surface to correct the spectral non-uniformity where present upon the surface.

Another object of the present invention is to provide an optical element utilizing an LED light source that can be used in apparatuses having multiple such optical elements to provide oblique illumination of a surface that is uniform both in spectrum as well as in irradiance.

Briefly described, the optical element embodying the present invention has a body with a base cavity for receiving a light source, e.g., LED, and outer sides providing total internal reflection. The body is asymmetrically shaped having an optical axis extending through its base and front face, minor and major axes orthogonal to each other and to such optical axis, where the body is elongated along its major axis. The body is positionable by tilting the front face so that the body's optical axis is at an oblique angle with respect to a target surface, such as a billboard, or other surface desired to be obliquely illuminated.

Curvatures of surfaces along the cavity and the outer sides are selected to enable the body to output illumination from the front face having a distribution (or irradiance profile) upon the target surface, along the height of the target surface and at least a portion of the width of the target surface, which has increased intensity with increasing height to provide at least substantially uniform illumination of the target surface along at least the height thereof. Preferably, the base cavity of the optical element has curvature along its side walls and central portion surfaces. Light received by the body via the central portion is directed to the front face, and light received by the body via the side walls is reflected by the outer surfaces by total internal reflection to the front face.

Depending on the application, the distribution of the output illumination from the optical element can extend along the entire width of the target surface to illuminate over an entirety of the area of the target surface, or multiple optical elements are adjacently disposed in a direction along the width of the target surface to enable the distribution of the output illumination upon the target surface from adjacent disposed ones of the body to at least partially overlap and provide such substantially uniform illumination in irradiance of an area of the target surface over a larger width of the target surface than provide by a single optical element. For example, the illumination distribution from the optical element along the horizontal direction maybe a Gaussian or bell-shaped, and adjacently disposed optical elements positioned so that their respective output illumination distribution falls to approximately one-half the peak value to overlap the one-half point of the output illumination distribution upon the target surface of the next adjacently disposed optical element to illuminate a larger area of the target surface with at least substantially uniform light. The number of optical elements used depends on the desire area to be illuminated as determined by the lighting application.

The optical element provides a distribution of output illumination from its body that has increased intensity along different portions at increasing height along the target surface in which the adjacent portions can partially overlap. This feature is provided by having curvature along the surface's outer sides, and surfaces of the cavity selected to control the amount (intensity) of light of the light source and its direction thereof from the front surface to different portions of the target surface along the height thereof. For example, a more distant portion of the target surface is provided with more light than more proximal portions of a target surface with respect to distance along body's front face from the target surface. In this manner, regardless of variation of the distance of the optical element with height of the target surface, illumination is made, almost if not entirely, uniform along such height.

One or more of the optical elements may be utilized in an apparatus (optical device, unit or fixture) where each of the one or more optical elements has its body internally illuminated by a different light source. When multiple optical elements are present in such apparatus, the distribution of output illumination from an apparatus along successive different portions of the width of the target surface at least partially overlap to illuminate the entire area of the target surface, such as described above.

The optical element's body is positionable at a distance from a bottom, top, or side edge of the target surface to provide a substantially uniform distribution of the output illumination at the oblique angle along one of the dimensions of the target surface of upwards, downwards, or sideways, respectively. In the above description of the optical element of the present invention, the term height represents one of such dimensions when the illumination is provided upwards or downwards; however, when the illumination is provided sideways the terms height and width are reversed where the width now represents one of the dimensions aligned with the major axis of the optical element's body.

For example, in a billboard illumination application, multiple apparatuses with one or more optical elements are positioned where each apparatus is at a distance, e.g., 2 to 4 feet, below the bottom edge of the billboard and extending out about a distance, e.g., 6 feet, from the bottom of each optical element's front face. The number of optical elements of each apparatus is used to provide sufficient illumination to the billboard. For example, the optical elements may each be disposed in a one-dimensional array or stacked in rows providing a two-dimensional array, as desired. Each billboard can be up to 48 feet wide or wider, and have multiple apparatuses spaced at even intervals, e.g., 4 to 12 feet apart, as needed depending on the area of the billboard each illuminates. Each apparatus will illuminate an area of the billboard directly in front of the fixture and overlapping the area illuminated by the adjacent apparatus to provide at least substantially uniform illumination in irradiance of the billboard.

The apparatus further provides a method for illuminating a surface at an angle comprising the steps of: providing at least one asymmetrically shaped body having a cavity for a light source to provide light within the cavity, positioning the body at a distance from one edge of a surface so that the front face of the body is tilted with respect to the surface and provides an unobstructed view of the surface from at least a front of the surface, and the asymmetrically shaped body directs light from the light source when present along a dimension of the surface, and selecting curvatures of surfaces along the cavity and outer sides of the body to output illumination from the front face having a distribution upon the target surface extending along the height of the target surface and along at least a portion of the width of the target surface, in which the output illumination from the body has increased intensity with increasing height along the target surface to provide at least substantially uniform illumination in irradiance of the target surface along at least the height of the target surface.

Although the target surface may be a billboard sign, or other vertical surface, the target surface may be flat or curved where light for illumination of such surface is desired that is off to one edge of the area of the target surface to be illuminated.

The optical element of the present invention may also be provided in an apparatus representing light fixtures for illumination of a vertical wall for architectural purposes, sometimes known as wall-washing.

The light sources preferably provide white light, but light sources may provide color light. Where multiple light sources and their associated optical elements are provided for illuminating a target surface or area, the light sources may be of different colors. Control of different ones of the light source thus can provide different color oblique illumination as desired.

The optical elements described herein can provide improved uniformity of oblique illumination with variation of intensity of less than 2 to 1 upon a target surface, which although substantially uniform can appear uniform in illumination to human visual perception of the target surface. This is in contrast with conventional approaches to oblique illumination, such as used for billboard illumination, which at best typically varies in intensity of 6 to 1 and thus can be noticeably non-uniform to the human eye, and can make poorly lit areas of the billboard more difficult to view.

Additionally, it is generally desirable for content illumination, such as signage and billboards, that the spectrum of the illumination be uniform across the illuminated surface. It has been found that some LEDs, particularly various types of white LEDs, have a spectral variation with emission angle. Conventional optics for spot or flood illumination will mix the off-axis emission with the on-axis emission to produce a spectrally uniform distribution at least within the central region of the light distribution. Oblique illumination systems, and specifically the optical element described above, use various angular components of the source light to illuminate specific areas of a surface, such as a billboard, to obtain a desired spatial uniformity. The consequence is that spectral mixing of the source light does not occur and a spectral variation across the surface results. This can be accounted for by providing additional optical elements along with the optical elements exhibiting such spectral variation. These additional optical elements provide light that corrects such spectral variation where present upon a surface being illuminated.

Thus, the present invention further provides an apparatus having multiple first optical elements which are of the same optical elements as described above, each having a body and an LED light source having an optical axis and providing illumination of a first color to the optical element's body over an angular range centered about the optical axis of the light source. Such illumination increases in spectral non-uniformity at increasing angles away from the optical axis. The first optical elements each have a front face disposed at an oblique angle with respect to a target surface to direct illumination upon the target surface along its width (or along a portion of its width) and entire height, where a portion of the target surface (e.g., the bottom or closest portion to the apparatus) illuminated by the first optical elements has illumination that is spectrally non-uniform and thus is of a different color than the first color. The rest (or upper portion) of target surface is at least substantially spectrally uniform in the first color due to mixing of on-axis and off-axis illumination from the first optical elements.

For example, in the case of a white LED light source the above first color is white, and light from the body of the first optical element appears white (or mostly white or bluish white) at angles on and near the optical axis, and more yellow in color at increasing +/− angles off the optical axis. This is due to the lower amounts of blue light being emitted from the LED light source at increasing angles from its optical axis. To correct this, the apparatus further has multiple additional optical elements, referred to herein as second optical elements, each having a body and an LED light source providing illumination of a second color having a spectrum which compensates for the non-uniform spectrum (or complementary thereto) of the first color LED light source. The front face of these second optical elements are also disposed at an oblique angle with respect to the target surface to direct their illumination to the portion of the target surface having illumination that is spectrally non-uniform from the LED light sources of the first optical elements. Along such portion, the illumination from the second optical elements combine with the illumination from the first optical elements to provide combined illumination that is spectrally uniform (at least substantially spectrally uniform) in the first color. The apparatus with both first and second optical element thus provides oblique illumination to a surface that is both at least substantially spectrally uniform in color and irradiance. This apparatus is especially useful in illuminating a vertical surface, such as a billboard.

In the example of the first optical elements each having an LED light source providing a first color that is white, the second optical elements each have an LED light source providing a second color that is blue. This blue light from the second optical elements when combined with the off-axis light illuminating the portion of the target surface that is spectrally non-uniform (yellow or yellowish in color) results in color white on the target surface along such portion. This thereby corrects the spectral non-uniformity of the first optical element's LED light source present on the target surface so that the entire surface illuminated by the first optical element is uniform in the color white. Although described for white light, the apparatus's first optical elements may have light sources of any color (or other radiation) that exhibit a similar spectral shift or non-uniformity, and then the color (or other radiation) of the light source of the second optical elements is selected to similarly compensate for such spectral non-uniformity.

The body of the first optical element is asymmetrically shaped to direct light from its light source along a height of the target surface to provide at least substantially uniform illumination (in irradiance) of the light of the light source upon the target surface along the height of the target surface. The body of the second optical elements are each of a shape, preferably rotationally symmetric, to provide light from their respective LED light sources to the portion of the target surface illumination that is spectrally non-uniform, as described above. Accordingly, the front faces of the second optical elements are at a different oblique angle than the front faces of the first optical elements.

The spatial distribution of the light from the second optical elements should match (or at least substantially match) the spatial distribution of the light from the first optical elements over the portion of the target surface that is spectrally non-uniform. If needed, the second optical elements further has an additional optical element for diffusing light that provides this function. This can ensure spectral uniformity (at least in perception to the human eye) along the portion of the target surface where light from the first and second optical elements combine. Alternatively, the body of the second optical elements may each be asymmetric like the first optical element (and at the same oblique angle), with an optical element that limits (e.g., blocks, spectrally filters, or to at least minimizes) light from the second optical element being directed by the second optical element towards other portion of the target surface that already appear spectrally uniform (at least substantially) in the first color and thus does not need light from the second optical element. Also, light from adjacently disposed second optical elements may partially overlap each other to provide uniform (at least substantially) distribution of illumination of the second color along the portion of the target surface receiving such light.

Preferably, the LED light sources of the second optical elements provide illumination which are of a common second color (e.g., single spectral region) to compensate for the spectral non-uniformity of the LED light source of the first optical elements where present on the target surface. However, when such spectral non-uniformity is over different spectral regions the second color comprises multiple different colors of different spectral regions so that the above described second optical elements add compensating light in each spectral region where needed on the target surface. In this case, groups of second optical element(s) are provided each having LED light source(s) providing illumination of a different color (second color), where each different color is associated with a different spectral region of non-uniformity of the LED light sources of the first optical elements. The illumination from each group of second optical element(s) of each of the different colors is provided to same area or different areas along the target surface as needed so that the target surface is spectrally uniform (at least substantially spectrally uniform) in the first color of the first optical elements. The multiple different second colors may be non-overlapping or partially overlapping in their spectrum as desired. For example, one group of second optical element(s) may have LED light source(s) providing blue light, and another group of second optical element(s) may have LED light source(s) providing red light so as to compensate for spectral non-uniformity of the LED light sources of the first optical elements along blue and red spectral regions, respectively, where present on the target surface. Preferably, the first and second optical elements form a two-dimensional array with respect to a target surface, such as a billboard. In the case of a vertical target surface, the light of the first optical element is directed along the entire height of the verticle surface (at least along a portion of the width thereof), while second optical elements are directed only along the bottom portion of the vertical surface exhibiting the spectral non-uniformity of light from the first optical elements. Less alternatively, the apparatus may have a single first optical element and a single second optical element.

Although the apparatus with the first and second optical elements is described above in connection with a billboard being the target surface, such apparatus is positionable at a distance from a bottom, top, or side edge of any target surface to provide a substantially uniform distribution of the output illumination both spectrally and in irradiance at the oblique angle along one of the dimensions of the target surface of upwards, downwards, or sideways, respectively, without obstruction of the view of the surface.

The present invention also provides a method for providing illumination to a surface at an oblique angle having the steps of: illuminating a target surface with at least one first optical element having a first body, a first light source having an optical axis and providing a first illumination of a first color to the first body over an angular range centered about the optical axis, and the first illumination increases in spectral non-uniformity with increasing angles away from the optical axis in the angular range; positioning a first front face of the first body disposed at an oblique angle with respect to a target surface to direct the first illumination upon the target surface in which a portion of the target surface having first illumination that is spectrally non-uniform appears different in color than the first color; illuminating a target surface with at least one second optical element having a second body, a second light source providing second illumination to the second body of a second color different than the first color; positioning a second front face of the second body disposed at an oblique angle with respect to the target surface to direct the second illumination to the portion of the target surface; and combining the second illumination and the first illumination along the portion to provide combined first and second illumination that appears spectrally uniform with the first color.

The term "substantially uniform illumination", as used herein, means illumination of a surface such that the surface appears uniformly bright and uniformly colored over the area of the surface that is illuminated. For a surface to appear uniformly bright and uniformly colored (spectrally) over the area of the surface, it is preferred that the irradiance of the surface be uniform over the area of the surface that is illuminated.

BRIEF DESCRIPTION OF THE DRAWINGS

The foregoing objects, features and advantages of the invention will become more apparent from a reading of the following description in connection with the accompanying drawings in which.

DETAILED DESCRIPTION OF THE INVENTION

Figure 1A:
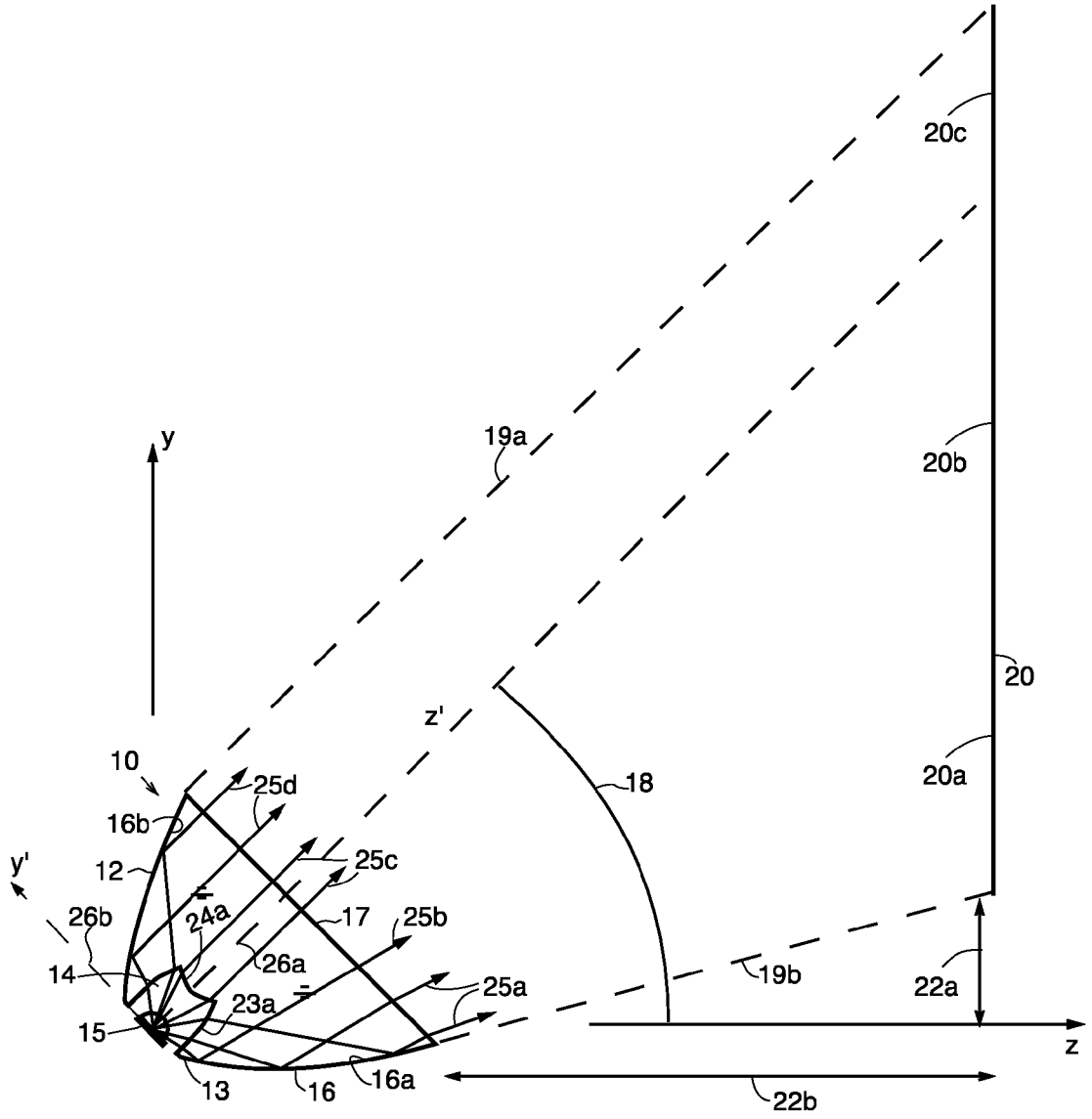
FIG. 1A is a cross-sectional view of an example of the optical element of the present invention relative to a target surface, such as a billboard, being illuminated, where the light is provided to the optical element from a light source.

Referring to FIG. 1, the optical element 10 of the present invention is shown having a body 12 with a base 13 having a cavity or recess 14 for receiving a light source 15, e.g., LED, outer sides 16 providing total internal reflection, and a front face 17. Body 12 is positioned above light source 15, such that the light source lies within the cavity 14 and is even or nearly even with the bottom of base 13. Front surface 17 is tilted to position the optical element 10 at an oblique angle 18 with respect to a target surface 20, such as a billboard, screen, wall, or other surface desired to be illuminated. The target output illumination from the optical element 10 extends between lines 19*a* and 19*b* upwards, i.e., to the top and bottom edges of surface 20. Lines 19*a* and 19*b* are defined as the viewing angle θ, as shown in FIG. 2. The body 12 is asymmetrically (or oblong) shaped about an optical axis z' (as opposed to being rotationally symmetric), and longer along the major axis y', than the minor axis x'. Axes x', y', and z' are orthogonal to each other and are also denoted as 26*c*, 26*b*, and 26*a*, respectively, in figures. Oblique angle 18 is between optical axis z' and a z axis, which extends from the optical element 10 in a horizontal direction that is orthogonal with a y axis along which extends the height of surface 20, where orthogonal axes x, y, z (see, e.g., FIGS. 2 and 5) are associated with the geometry of surface 20, and orthogonal axes x', y', z' are associated with the geometry of body 12.

The body 12 along axes z', y', and x' represents the thickness, height, and width, respectively, of optical element 10. Front face 17 is along a plane parallel to the major and minor axes y' and x' of body 12. The minor axis x' is not shown in FIG. 1A since this figure is a cross-section along the major axis y' and the optical axis z'. The optical element 10 is positioned so as to be offset by a vertical distance along the y axis, as denoted by arrow 22*a*, and a horizontal distance along the z axis, as denoted by arrow 22*b*. The oblique angle 18 may be varied by adjusting the tilt of front face 18 (and hence optical axis z' position) and distances 22*a* and 22*b* may be varied so that viewing angle θ of optical element 10 distributes illumination in an asymmetric fashion across the illuminated surface 20 along the entire height thereof and at least a portion of its width.

Figure 2:
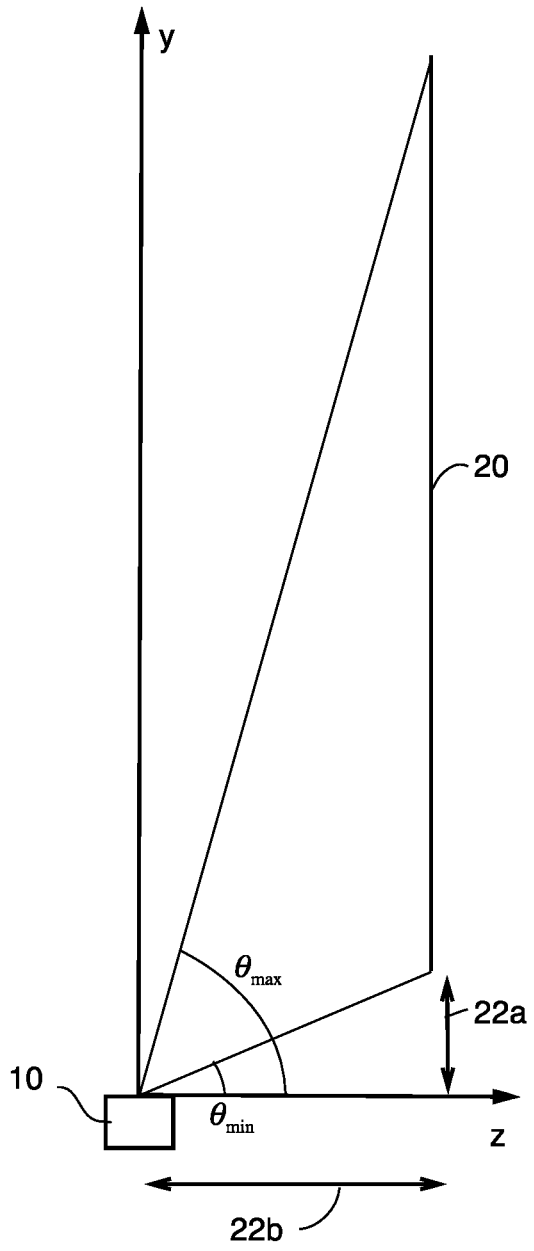
FIG. 2 is a diagram showing the geometry of illumination angles of the target surface and optical element of FIG. 1A.

FIG. 1A shows the relative relations of the components and is not a scaled drawing. In an example of surface 20 being a billboard of height 15 to 20 feet, the distance 22*b* of the optical element 10 to the billboard is typically 6 to 8 feet and the vertical displacement 22*a* is 3 to 4 feet. The optical element 10 itself will have height, width, and length dimensions typically on the order of 1 to 1.5 inches.

The body 12 of optical element 10 is of a solid, optically transparent material, such as plastic or glass, which may be molded to provide a selected shape of surfaces of walls 23, central portion 24, and outer sides 16 providing the desired illumination distribution to surface 20 in terms of the illumination's overall irradiance profile, as will be described in more detail below.

Figure 1B:
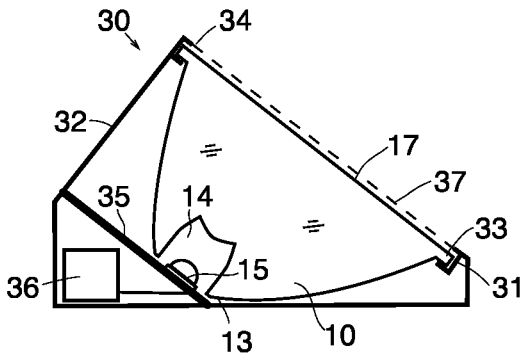
FIG. 1B is an example of an apparatus having the optical element of FIG. 1A.
Figure 1C:
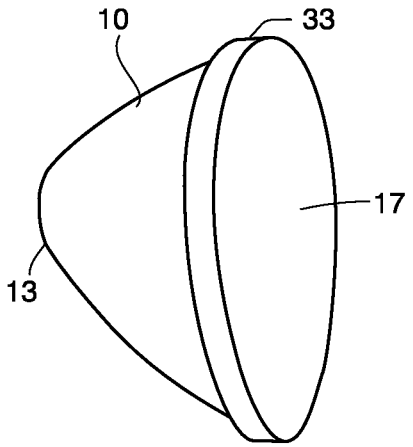
FIG. 1C is a perspective view of the optical element of FIG. 1A with a mounting flange.
Figure 1D:
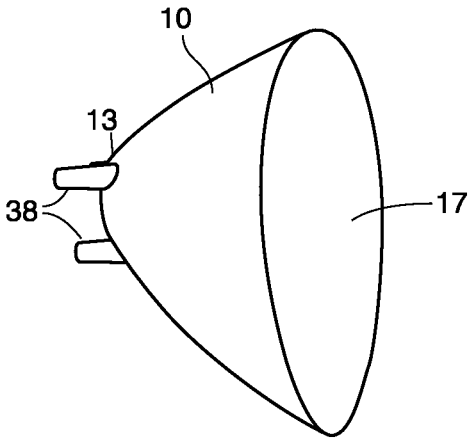
FIG. 1D is a perspective view of the optical element of FIG. 1A with mounting leg members.

One or more optical elements 10 and their associated light sources 15 may be part of a variety of different apparatuses 30. FIG. 1B shows an example of apparatus 30 having a single optical element 10. Optical element 10 is mounted in housing 32 by a mounting flange 33 extending around the front of body 12 being and received in a mounting fixture, such as a slot 31, about an opening 34 of housing 32. This positions the optical element 10 so that light source 15 is disposed within base cavity 14 just inside the entrance thereof central along optical axis z'. The optical element 10 with flange 33 is also shown in FIG. 1C.

Light source 15 is preferably a small, wide-angle light source, such as an LED as shown in the figures. The LED may be mounted in apparatus 30 upon a circuit board 35 having electronic circuitry for enabling LED operation. The LED for example may be of a high intensity type, such as providing 1000 lumens of white light, as for example a CREE XM-L LED. Electronic circuitry on circuit board 35 may be per specifications of the LED manufacturer. Such circuitry may be powered by a battery 36, or external power supply. An optional window 37, such as of transparent optical material (e.g., plastic of glass) may also be provided to serve as a cover to the front of the apparatus 30 to enclose optical element 10 and other components within housing 32. Other optical element 10 mounting mechanisms may be used than flange 33, such as by providing leg members 38, such as three in number, extending from the base 13, in which a mounting fixture is provided in housing 32 to capture such leg members (see FIG. 1D).

Figure 1E:
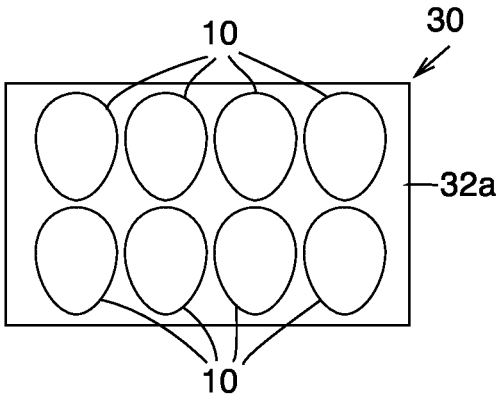
FIG. 1E is a front view of an example of an apparatus having a two-dimensional array of the optical elements of FIG. 1A.
Figure 1F:
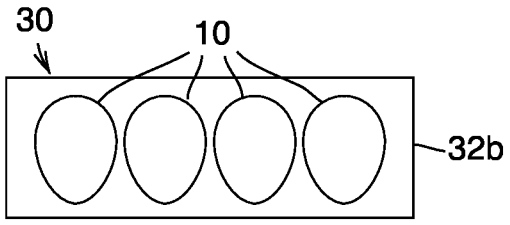
FIG. 1F is a front view of an example of an apparatus having a one-dimensional array of the optical elements of FIG. 1A.

Examples of apparatuses 30 with multiple optical elements and associated light sources are shown in FIGS. 1E and 1F. FIGS. 1E and 1F show a front view of a two dimensional array, and a one dimensional array of light sources 10 in a housing 32*a* and 32*b*, respectively. Other orientations and number of optical elements 10 may be used to provide the desired illumination to surface 20. Preferably, each of the optical elements is identical in shape, size and function. The optical elements may be randomly disposed in pattern with a common tilt of their front faces 17 or in a one or two dimensional array. Other configuration of apparatus 30 may be used to support optical element(s) 10 and associated light source(s) 15 with at least LED circuitry to support operation/control of the light source, as desired. Other light sources 15 may be used than an LED to provide white light.

Each light source 15 in apparatus 30 preferably provides white light, but may provide light of other color, or where multiple light sources are present may provide different color light. Circuitry within or connected to apparatus 30 can operate apparatus 30, and where multiple colors are present control different ones of the light sources to provide different color light illumination to surface 20 as desired.

The optical design of optical element 10 will now be described. As shown in FIG. 2, optical element 10 may be mounted several feet below the bottom edge of the area of surface 20 to be illuminated along the y axis (see arrow 22*a*), and out several feet in front of the vertical plane of the surface 20 along the z axis (see arrow 22*b*). Optical element 10 is illustrated in FIG. 2 as a block, but such block may also be considered apparatus 30. For purposes of illustration, surface 20 is considered a billboard, but the optical design can be utilized for any oblique illumination application. The lower edge of the area to be illuminated is at an angle $\theta_{min}$ above the horizontal to optical element 10. The top edge of the area of surface 20 to be illuminated is at an angle $\theta_{max}$ above the horizontal. It is between these angles that light is to be projected from the optical element 10 to provide at least substantially uniform illumination is terms of irradiance (power per unit area) distribution across surface 20 with minimal light outside this vertical range to minimize wasted light and light pollution. This geometry dictates that the intensity of the light from optical element 10 should follow a $1/\cos^3\theta$dependence for the angle θ between $\theta_{min}$ and $\theta_{max}$ as measured from the horizontal z axis. The intensity of the light should fall off quickly outside this vertical range. As an example, the illumination angles for a 16 foot high billboard surface illuminated by an optical element 10 that is 3 feet below the bottom edge (see arrow 22*a*) and 6 feet out in front of the surface 20 (see arrow 22*b*) are about 25° for $\theta_{min}$ to about 75° for $\theta_{max}$. This same analysis can be applied to side or top illuminated surfaces with the appropriate change of orientation.

Figure 3A:
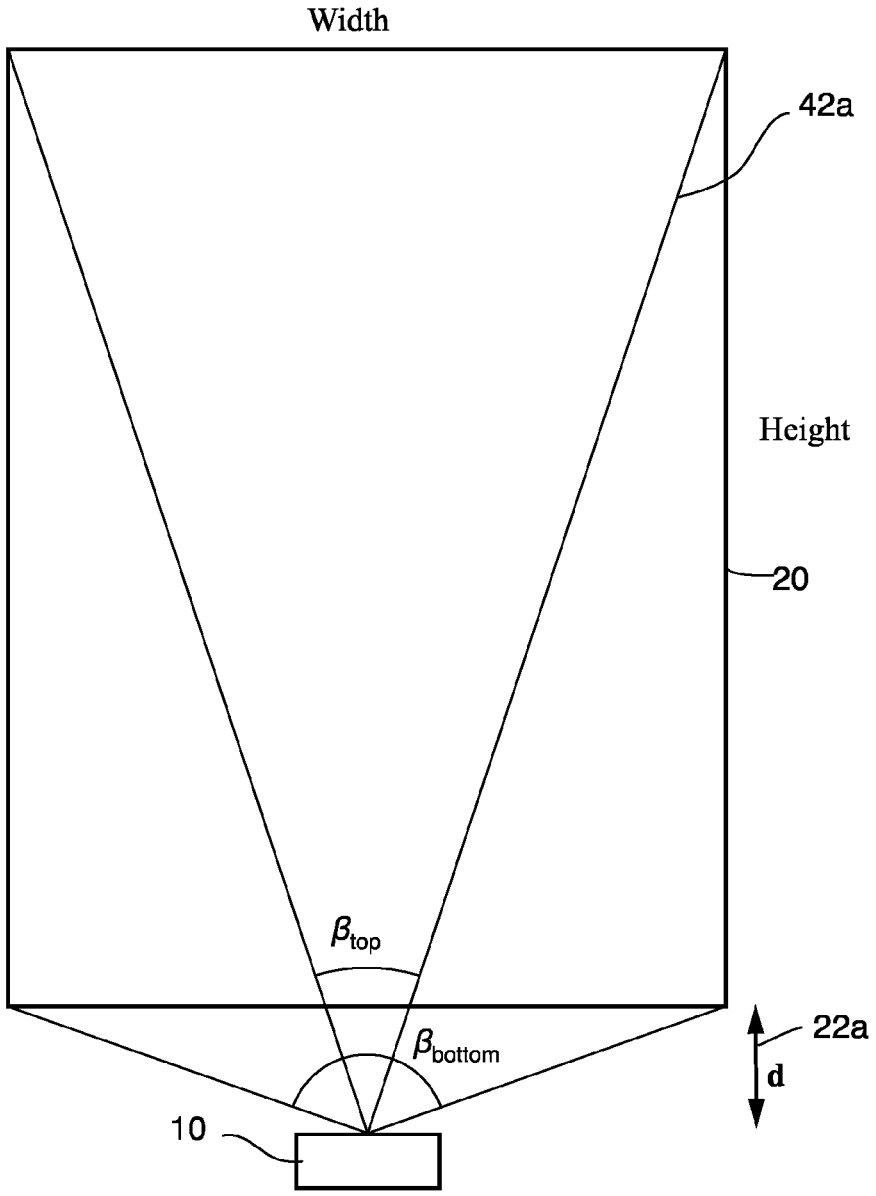
FIG. 3A is a diagram showing the geometry of illumination angles taken from the front view of the target surface and optical element of FIG. 1A.
Figure 3B:
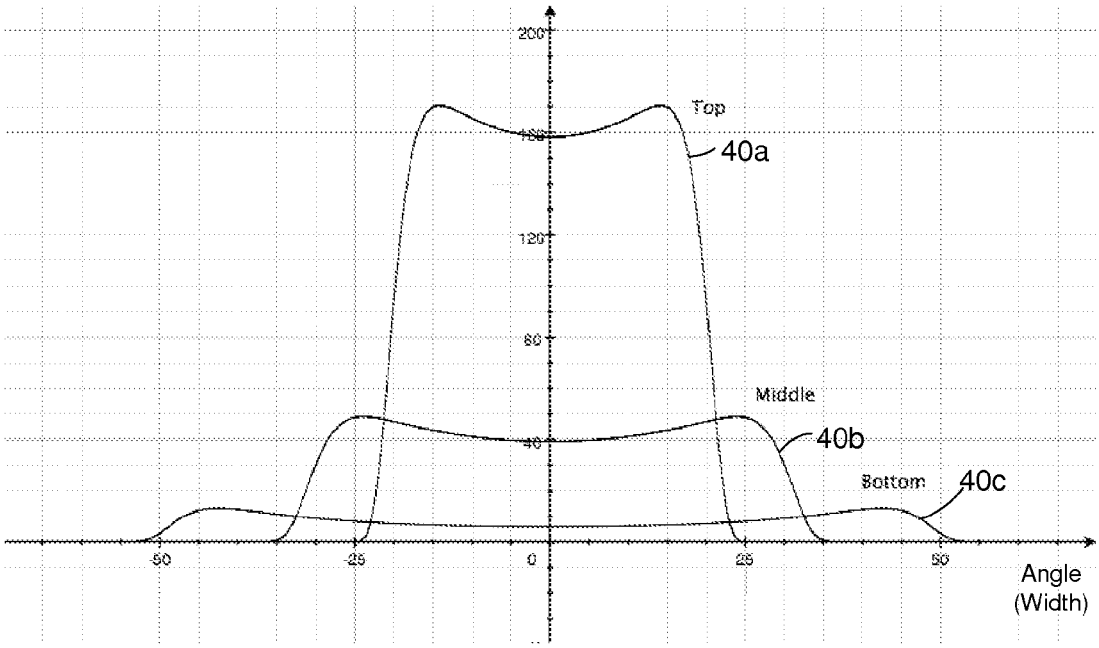
FIG. 3B is a graph showing the intensity distributions versus angle (degrees) at top, middle, and bottom of the target surface using a single optical element of FIG. 1A to illustrate the distribution of illumination outputted from the optical element upon the target surface.

Referring to the front view shown in FIG. 3A, the horizontal spread of the light from optical element 10 is much greater at the bottom of the surface 20 than at the top. Optical element 10 distributes the light across the surface 20 in a narrow horizontal angular spread toward the top of the illuminated surface 20 and a wider horizontal angular spread toward the bottom in order to cover the entire surface 20. In addition, since the top of the illuminated surface 20 is farther from the optical element 10, the optical element 10 projects more light at the top than at the bottom. FIG. 3B shows the intensity distribution curves (power as a function of angle) for the light projected toward the top (curve 40*a*), middle (curve 40*b*), and bottom (curve 40*c*) of the surface 20 to provide at least substantial uniform irradiance across the illuminated surface 20. Thus, the surface curvatures along sides 16, side walls 23, and central portion 24 collect substantially all the light from the light source 15 to provide from front face 17 output illumination having an irradiance profile along the top, middle, and bottom portions upon surface 20 so that increased intensity occurs with increasing height to uniformly illuminate at least substantially the surface along its height at oblique angle 18.

Consider a surface 20 that is 16 feet tall and 12 feet wide. For the optical element 10 when placed 3 feet below the bottom edge of surface 20 and 6 feet out from the surface 20, the angle subtended across the top of surface 20 is about 33° (±16.5°), and across the bottom is 84° (±42°). Each of these curves 40*a*, 40*b*, and 40*c* has more light that must be projected toward the edges of the surface 20 than at the center for any given horizontal slice through the surface 20. The combination of curves 40*a*, 40*b*, and 40*c* provides an irradiance profile of illumination that is almost, if not entirely, uniform along the entire vertical height of surface 20 over a given width of surface 20. For example, such irradiance profile may be uniform in width but other profiles also may be used.

In one case, the irradiance profile 42*a* of the output illumination from optical element 10 may extend along the entire width of surface 20, as shown for example in FIG. 3A, and thus over an entirety of the area of such surface. The horizontal variation of the irradiance from the fixture has a flat, almost if not entirely, uniform distribution over a defined area both horizontally and vertically. This is useful for vertical surfaces that are narrow and can be illuminated by an apparatus 30 having a single optical element 10, or a single apparatus 30 having multiple optical elements 10 such as shown, for example, in FIGS. 1E and 1F.

In other cases, the surface is much wider, and thus the output illumination from a single optical element 10 may extend along a portion of the width of surface 20. To address this, multiple optical elements 10 are disposed in their associated apparatus 30 adjacently in a one-dimensional array spaced the same offset in vertical and horizontal distances from the bottom of surface 20 to enable the illumination distribution upon surface 20 from adjacent disposed optical elements 10 to overlap at least partially and to illuminate an area of the target surface over a larger width of the target surface than is provided by a single one of the body, and preferably sufficient apparatuses 30 are provided to illuminate the entire area of surface 20.

Figure 4A:
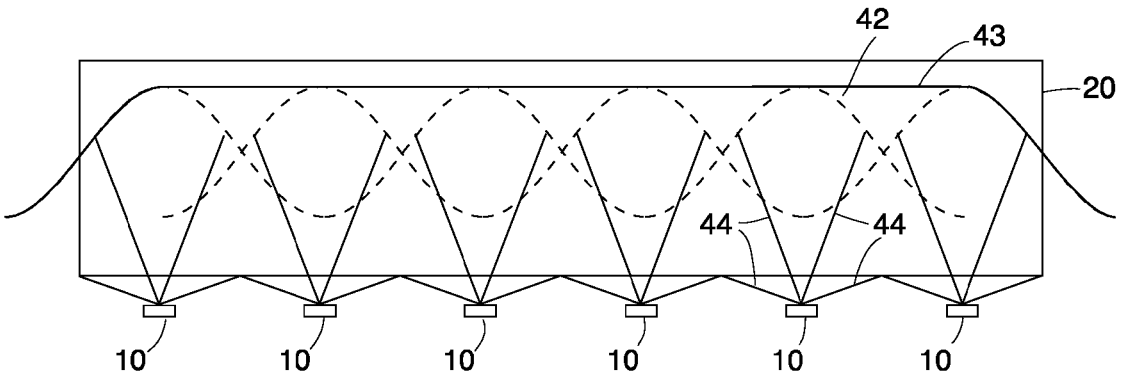
FIG. 4A is a schematic diagram of FIG. 1A showing the distribution (or irradiance profile) of illumination output of FIG. 3B for multiple optical elements evenly spaced in front of the target surface, where the dashed curves represent the light distribution from individual optical elements, and the solid curve is the total, summed distribution of adjacent optical elements.
Figure 4B:
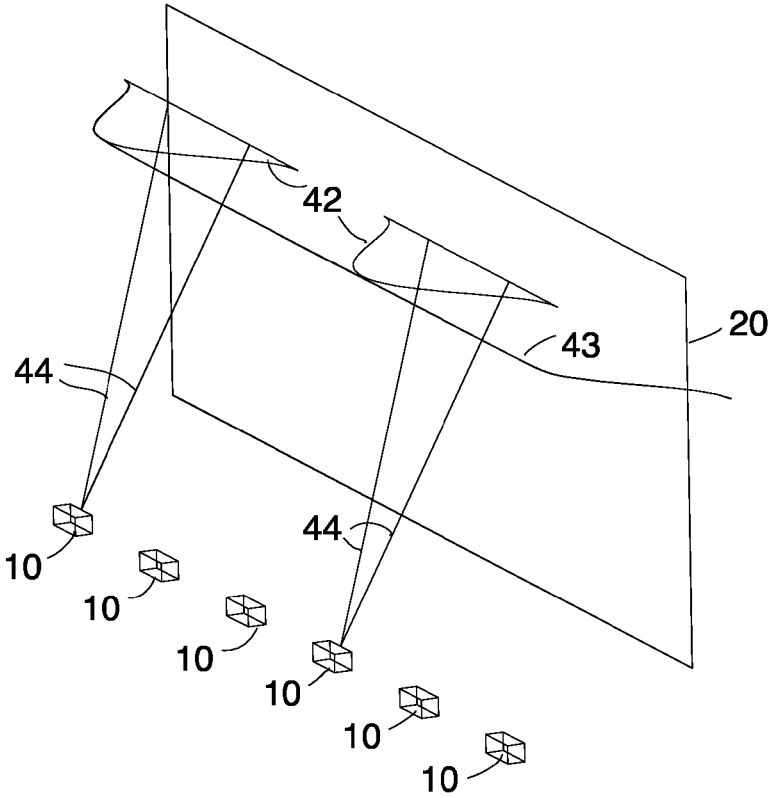
FIG. 4B is a perspective view of FIG. 4A showing that the summed distribution is uniform along the target surface.
Figure 5:
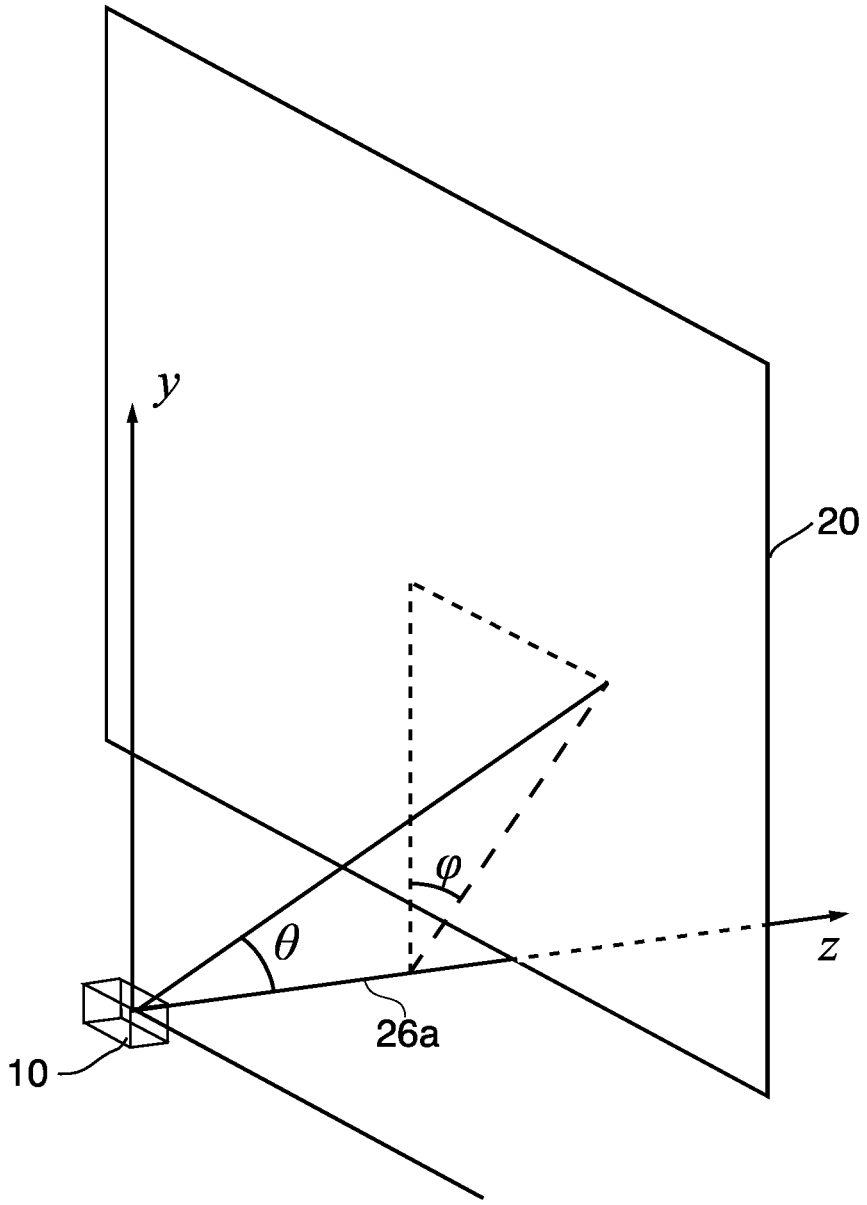
FIG. 5 is a perspective view showing the geometry of illumination angles of the target surface and optical element of FIG. 1A.

Consider an example of the surface 20 being a wide billboard or vertical surface 20 having multiple optical elements 10, each providing a irradiance profile with a horizontal illumination of the light on the surface 20 that is Gaussian or bell-shaped, so that sufficient overlap of the light distribution from one optical element 10 to the next provides the desired uniformity, as shown for example in FIGS. 4A and 4B. For purposes of illustration, six optical elements 10 are shown, but another number may be used depending on the width of surface 20. Further, the optical elements 10 are evenly spaced across the bottom of surface 20 to provide sufficient illumination. If the width of the surface 20 is W and there are N optical elements 10, then the spacing between fixtures is W/N with the end optical element 10 a distance W/2N from the edge of the surface 20. It is desirable that the light from each optical element 10 overlaps approximately one half the light distribution from each neighboring optical element. In doing so, the total light distribution can be made as uniform as possible. As an example, each optical element 10 produces an intensity distribution of the form $$I = I_0 \frac{z_0^2}{\cos^3\theta} \exp\left[-\frac{(z_0 \tan\theta \cos\phi)^2}{2w^2}\right],\ \theta_{min} \le \theta \le \theta_{max} \tag{1}$$

as a function of vertical angle θ and polar angle ϕ. These angles are shown in FIG. 5.

The parameter $z_0$ is the distance the optical element 10 extends out from the surface 20, and w is a width parameter for the Gaussian function. This form produces an irradiance profile 42 on the surface 20 that is Gaussian in shape along the horizontal direction. The width parameter is chosen so that the irradiance from each optical element falls to just about half its peak value at the midpoint between optical elements. The overall sum will then be nearly uniform between the light fixtures and gradually fall off at the sides.

Another possible intensity distribution from a single optical element 10 takes the form $$I = I_0 \frac{z_0^2}{\cos^3\theta} \cos^2\left[\frac{(z_0 \tan\theta \cos\phi)}{w}\pi\right], \tag{2}$$

$$\text{for } \theta_{min} \le \theta \le \theta_{max} \text{ and } \left|\frac{z_0 \tan\theta \cos\phi}{w}\right| \le 1.$$

In this case the width parameter is chosen so that the $\cos^2$ function falls to ½ at the midpoint between fixtures. In this way the total irradiance on the surface 20 of this example of billboard illumination will be uniform between the optical elements 20. Although such forms of intensity are described, other intensity distributions may be provided.

In the example of FIGS. 4A and 4B, the output irradiance profile 42 contributes to the illumination on the surface 20 along a horizontal line from each optical element 10 shown by the dashed lines, and the sum of the overlapping profiles, shown by the solid line 43, from all the optical elements 10. The light distribution is almost, if not entirely, uniform between the optical elements and has a gradual fall off at the edges. Increasing the number of light fixtures reduces the horizontal width of the irradiance profile from each fixture and minimizes this fall off at the edges. Optionally, the number of optical elements 10 can be increased by one while maintaining the same spacing and the array can be positioned so that the two end elements are in line with the edges of the surface 20. In this way the fall off from the end elements is beyond the surface 20 and the entire surface will be substantially uniformly illuminated. This can provide irradiance variation from maximum to minimum across the surface 20 at or less than 2:1 versus a 6:1 variation from conventional metal halide lamp and nearly 8:1 from some current LED oblique illumination systems.

To provide the above described illumination distribution in the horizontal and vertical directions along a surface 20, the following equations may be used which define the curvature of the surfaces along optical element 10. Using the coordinates shown in FIG. 6A, the surfaces 16, 23, and 24 can be expressed by individual quadratic equations that take the general form $$Ay'^2 + By'z' + Cz'^2 + Dy' + Ez' = F, \tag{3}$$

where the A–F coefficients are unique for each surface. These are conic curves that can also be represented in parametric form as $$P(t) = \frac{(1-t)^2 P_0 + 2(1-t)tP_1 w_1 + t^2 P_2}{(1-t)^2 + 2(1-t)tw_1 + t^2}, \tag{4}$$

where P is a vector for the (y',z') point lying on the curve and the endpoints $P_0$=P(t=0) and $P_2$=P(t=1). The point $P_1$ in an intermediate control point and $w_1$ is a weighting factor that deforms the curve. Higher weight values cause the curve to pass closer to the control point. A weight value of 0 defines a straight line between end points $P_0$ and $P_2$.

Figure 7A:
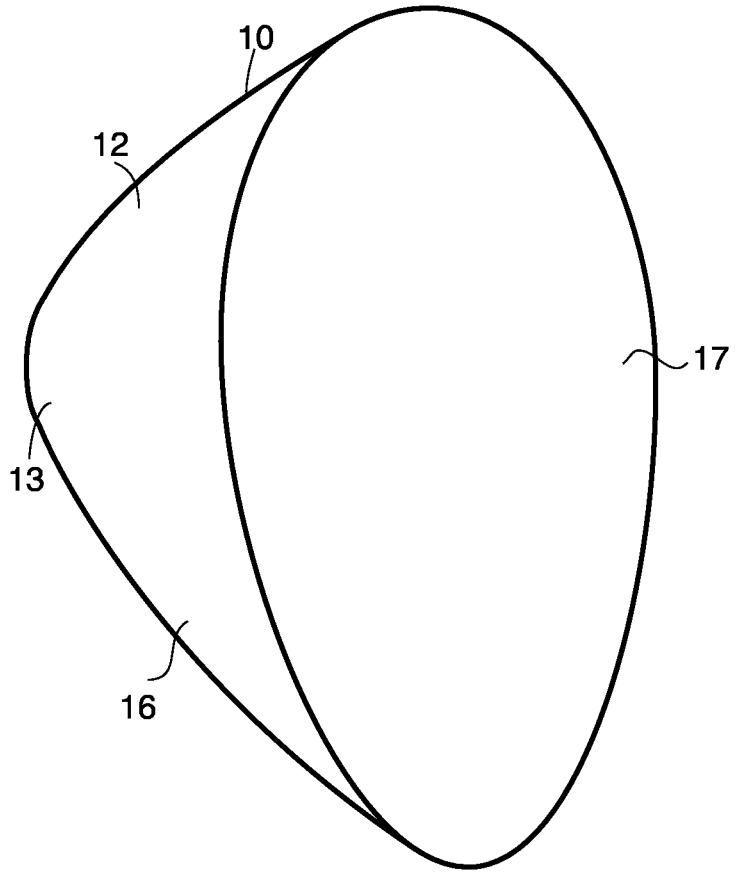
FIGS. 7A and 7B are perspective and front views, respectively, of the optical element of FIG. 1A for the curvature of surfaces of FIGS. 6A-6D.
Figure 7B:
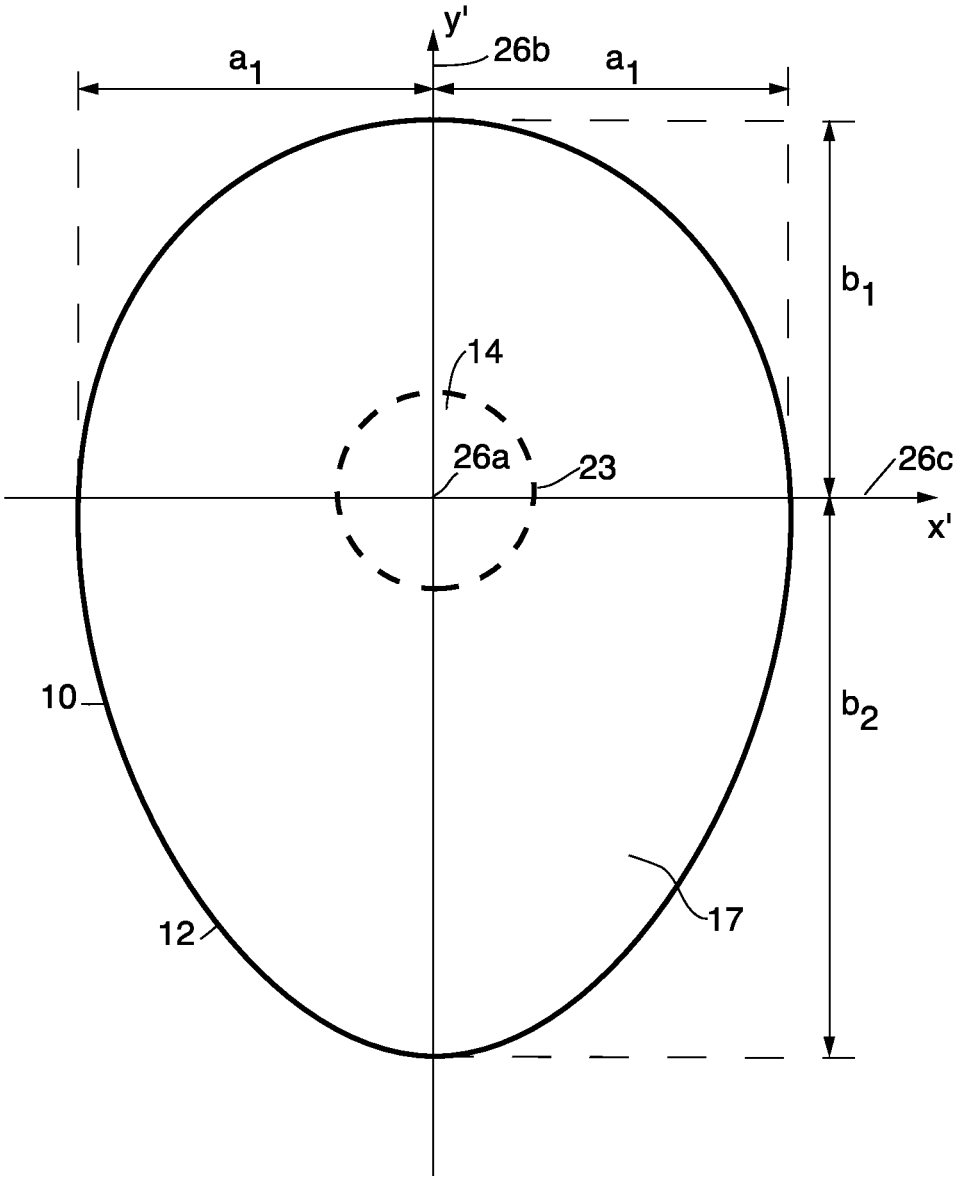

The perimeter of the output face 17 of the optical element as shown in FIG. 7B is a modified ellipse and has the equation:

$$\frac{x'^2}{a^2}\left(\frac{1}{1+c(y'-d)}\right)+\frac{(y'-d)^2}{b^2}=1, \quad (5)$$

where a is the semiminor axis and b is the semimajor axis. The offset parameter d is used to place one focus of the ellipse on the optical axis z'. In the example of the perimeter of output face 17 shown in FIG. 7B, values of a, b, c, and d in the above Equation (5) are 13.5, 18, 0.018, and −3.48, respectively. The endpoints $P_2$ of the outer sides 16 as defined by Equation (4) trace along this modified ellipse to sweep out the shape of the outer sides 16.

Figure 6A:
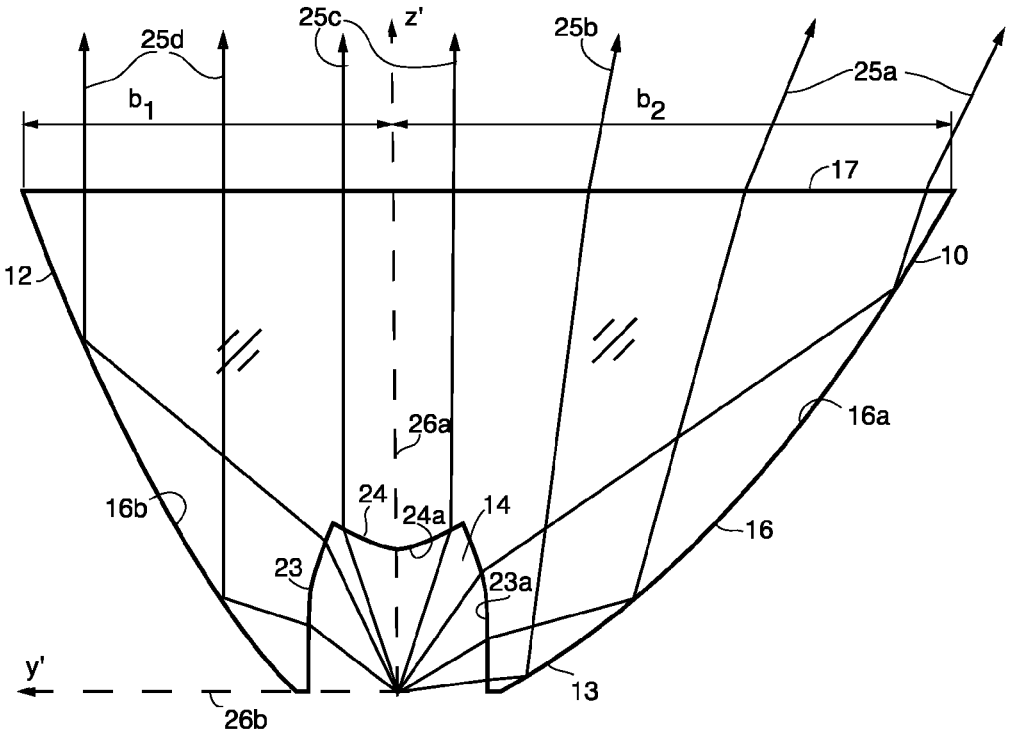
FIGS. 6A and 6B are cross-sections in the plane of the major axis and optical axis of the optical element of FIG. 1A without and with an LED, respectively, to show the light rays from a point source.
Figure 6B:
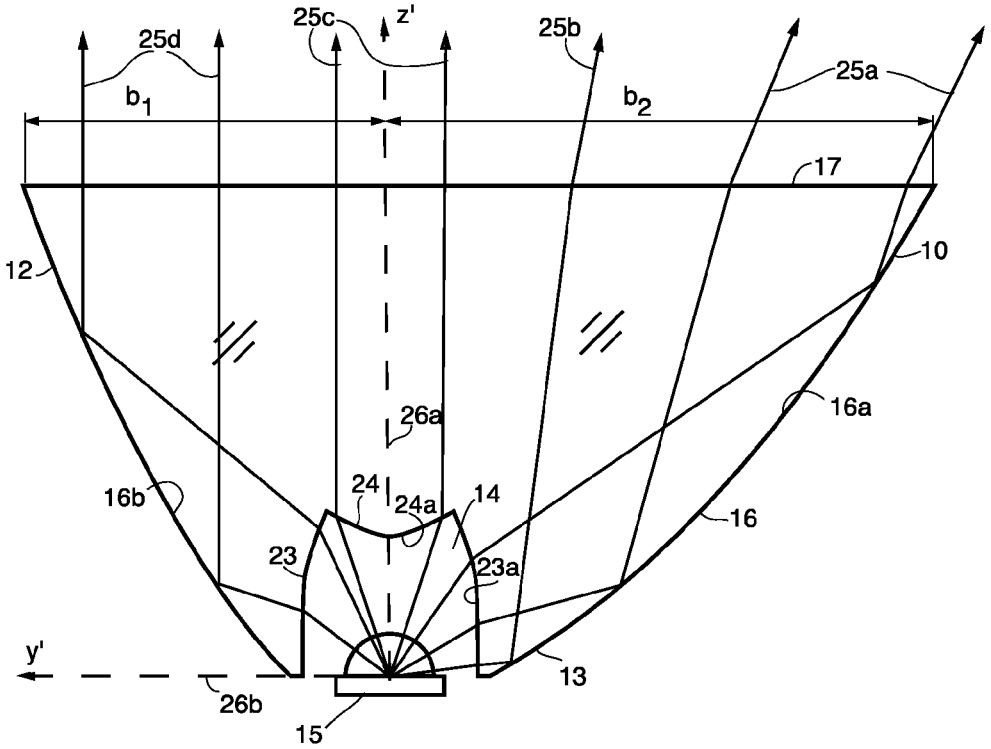
Figure 6C:
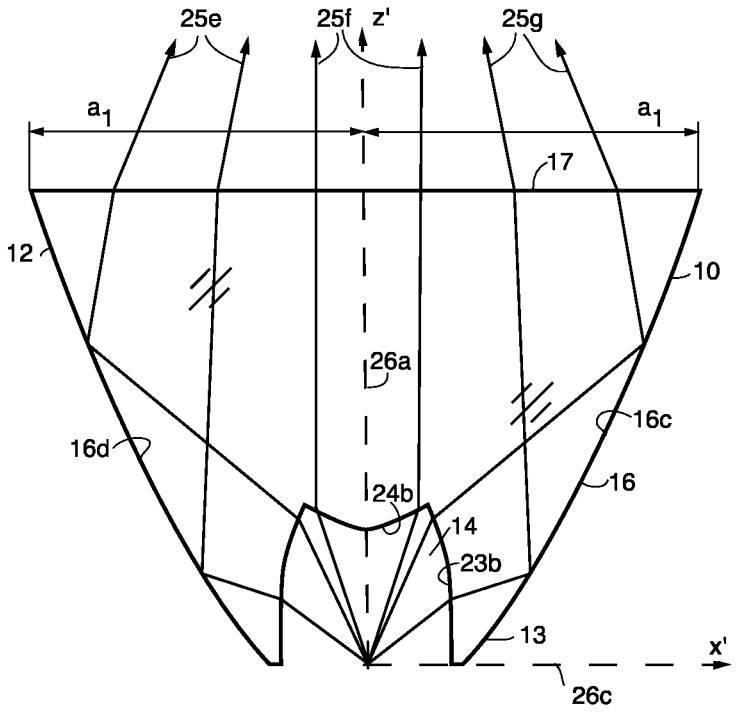
FIGS. 6C and 6D are cross-sections in the plane of the minor axis and optical axis of the optical element of FIG. 1A without and with an LED, respectively, to show the light rays from a point source.
Figure 6D:
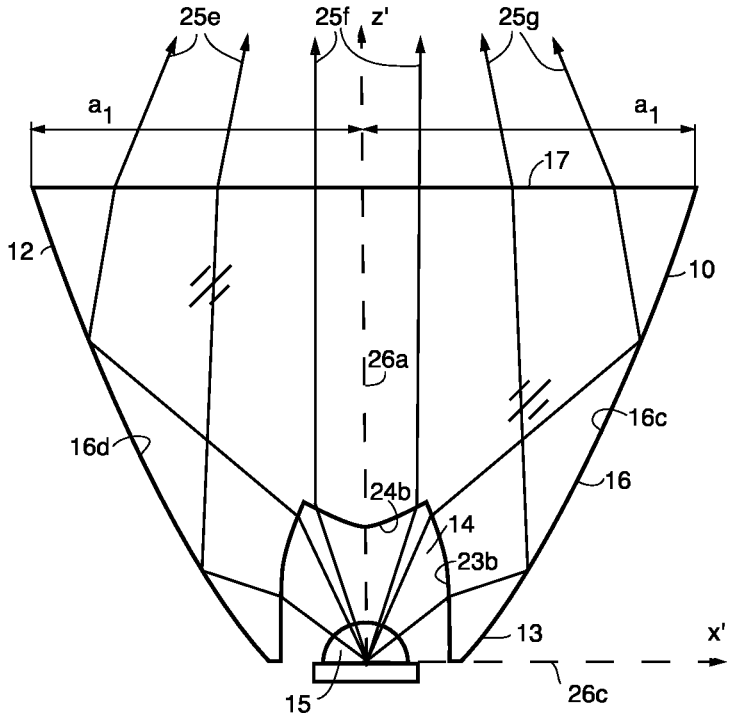

One example of optical element 10 is shown in FIG. 1A and FIGS. 6A-6D, where FIGS. 6A and 6B are cross sections of the optical element along the major axis y' and FIGS. 6C and 6D are cross sections of the optical element along the minor axis x', along with light rays 25*a*-25*g* from a point source provided by light source 15. FIGS. 7A and 7B show the optical element 10 from right perspective and front views, respectively. The intersection of the major axis y' and minor axis x' in FIG. 7B represents the optical axis z' extending perpendicular to the plane of the figure, and defines the location of the light source 15 in cavity 14 illustrated in dashed lines around optical axis z'.

The length and width of the optical element 10 are determined by the parameters $b_1$, $b_2$, and $a_1$, as best shown in FIG. 7B. In FIG. 7B, the optical element 10 is symmetric along the minor axis x' on either side about the major axis y'. The cavity 14 of the optical element 10 surrounding light source 15 as stated earlier, has the side walls 23 and central portion 24, which in this example have concave and convex surfaces 23*a* and 24*a*, respectively. Further in this example, the cavity 14 is rotationally symmetric about the optical axis z'. The side walls 23 and central portion 24 serve two distinct functions. The central portion 24 collects narrow-angle light from light source 15 and collimates it, sending it directly through the output front face 17 shown by rays 25*c* and 25*f*. It is optimized to obtain the best collimation for the light that it collects. Given the physical extent of a light source 15 provided by an LED, the best collimation will yield a beam of light that has a divergence of 1 to 2 degrees about the optical axis z'.

The side walls 23 collect the wide-angle light emitted from the light source 15 and by refraction direct it toward the outer sides 16. This light strikes the outer sides 16 at an angle beyond the critical angle and undergoes total internal reflection (TIR). The light then exits the optical element 10 through the output front face 17. The geometry of these surfaces provided by side walls 23, central portion 24, and outer sides 16 determines how the individual light rays 25*a*-*g* exit the optical element 10 and illuminate surface 20.

In the example of FIG. 1A, the optical element 10 is tilted such that the optical axis z' points toward the upper or distal portion 20*c* of surface 20, for example, at 70° above the horizontal for the surface with a maximum angle of about 75°. Outer sides 16 may be considered as having a lower side 16*a* and upper side 16*b* along the major axis y' on either side of the optical axis z'. The upper side 16*b* above the optical axis z' in conjunction with the concave surface 23*a* obtain the best collimation for the rays 25*d*, emitted from the light source 15 in the plane containing the major and optical axes. The physical extent of the light source 15 determines the minimum divergence of these rays. A larger light source 15 will give a larger divergence. A minimum divergence for these rays 25*c* and 25*d* when emitted from the light source is preferred for the following reason. Since the light source 15 and the optical element 10 are pointed toward the upper portion 20*c* of surface 20, as shown in FIG. 1A, the light distribution should fall off quickly for angles above the optical axis z' so as to minimize the light above surface 20, thus reducing wasted light and light pollution. This optimization determines the shape of the outer surface of the upper side 16*b*, the shape of side walls 23, and consequently the $b_1$ parameter for the upper portion of the optical element 10 (see FIG. 7B).

The extent of the elongation of the optical element 10 along the major axis y' in FIG. 7B is determined by the $b_2$ parameter. This parameter is chosen to provide illumination to the lower or proximal portion 20*a* of the surface 20. Since $b_2$ is greater than $b_1$, the rays 25*a* from the light source 15 that strike the outer surface of the lower side 16*a* on this half of the optical element 10 do so at more of a glancing angle than rays 25*d* (see FIGS. 6A and 6B). Thus these rays 25*a* will not be collimated and will exit the optical element 10 diverging away from the optical axis z' so as to illuminate the lower portion 20*a* of the billboard (see FIG. 1A). The curvature profile of the outer surface of the lower side 16*a* along a plane containing the major and optical axis z' is optimized to obtain the desired light distribution on the lower portion 20*a* of surface 20 which extends upwards to meet the upper portion 20*c* where the light rays 25*c* from central portion 24 fall off about a middle portion 20*b* overlapping the upper and lower portions 20*a* and 20*c*.

The width of the optical element 10 is determined by the parameter $a_1$ as shown in FIGS. 6C and 6D, and controls the spread of the light across the width of surface 20. Because $a_1$ is in general less than $b_1$ the light reflected off the outer sides 16 of the optical element 10 in the plane containing the minor and optical axes and transmitted through the front face 17 will not be collimated, as shown by the rays 25*e* and 25*g*. These rays cross the optical axis z' at various locations before striking surface 20. The value of the parameter $a_1$ determines the extent to which these rays 25*e* and 25*g* spread across the width of surface 20. Smaller $a_1$ values cause the rays 25*e* and 25*g* to spread wider. In this example, $a_1$ is selected to be smaller than $b_1$. One could also choose to make $a_1$ larger than $b_1$. If $a_1$ is selected to be larger than $b_1$ then the rays 25*e* and 25*g* in the plane containing the minor and optical axes reflecting off the sides of the optical element 10 would not cross the optical axis z' and would continue to diverge toward the surface 20. This would make the optical element 10 larger containing a larger volume of material. The surface curvature profile of the outer sides 16 in the plane of the minor and optical axes is optimized to provide the desired distribution across the width of the surface 20.

The shape of the flat front face 17 of optical element 10 is governed by one of a number of possible mathematical expressions, one of which was given in Equation (5) above. In general it is a tear-drop or egg shape and is chosen in combination with the parameters $b_1$, $b_2$, and $a_1$ to produce the desired light distribution from optical element 10. The surface curvature profiles of the outer sides 16 follow the top edge of front face 17 and base 13 to form a smooth, continuous shape.

An example of the (y', z') points from Equation (4) that define the surfaces 16*b*, 23*a*, 24*a*, and 16*a* is given in the table below where the dimensions are millimeters.

| | |
|---|---|
| 16b | $P_0$ = (3.96, 0) |
| | $P_1$ = (9.33, 5.36), $w_1$ = 0.945 |
| | $P_2$ = (14.52, 19.38) |
| 23a | $P_0$ = (3.46, 0) |
| | $P_1$ = (3.44, 4.18), $w_1$ = 4.19 |
| | $P_2$ = (2.51, 6.49) |

-continued

| | |
|---|---|
| 24a | $P_0 = (0.1, 5.51)$ |
| | $P_1 = (1.77, 5.77), w_1 = 0.34$ |
| | $P_2 = (14.52, 19.38)$ |
| 16a | $P_0 = (-3.96, 0)$ |
| | $P_1 = (-13.81, 5.36), w_1 = 0.945$ |
| | $P_2 = (-21.48, 19.38)$ |

The parameter $a_1$=13.65 mm, $b_1$=14.52 mm, and $b_2$=21.48 mm.

In summary, as shown in FIGS. 1A, 6A, and 6B, outer sides 16 may be considered as having a lower side 16*a* and upper side 16*b* along the major axis y' on either side of the optical axis z'. Side walls 23 may have concave surfaces 23*a* along the major axis y', and central portion 24 may have convex surfaces 24*a* along the major axis y'. The curvature of the interior surfaces along the lower side 16*a* of outer sides 16 reflects light, via front face 17, received from concave surfaces 23*a* to the lower side 20*a* of surface 20 of FIG. 1A (as denoted by multiple directions of non-collimated light rays 25*a*). The curvature of the surfaces along the upper side 16*b* of outer sides 16 reflects light, via front face 17, received from concave surfaces 23*a* to the upper portion 20*c* (along a lower portion thereof of intermediate portion 20*b* between portions 20*a* and 20*c*) of surface 20 of FIG. 1A (as denoted by light rays 25*d*), and curvature along central portion 24 also directs light to upper portion 20*c* of surface 20 of FIG. 1A (as denoted by light rays 25*c*). Both upper side 16*b* and central portion 24 substantially or entirely collimate light in a direction along optical axis z'. Thus lower side 16*a* directs light away from the optical axis z' as the optical axis z' extends away from front face 17. This controls the output illumination distribution of optical element 10 along the height of surface 20.

As shown in FIGS. 6C, and 6D, outer sides 16 may be considered as having a right side 16*c* and left side 16*d* along the minor axis x' on either side of the optical axis z'. Side walls 23 may have concave surfaces 23*b* along the minor axis x', and central portion 24 may have convex surfaces 24*b* along the minor axis x'. The curvatures along right and left sides 16*c* and 16*d* are preferably symmetric and each directs light, via front face 17, received from concave surface 23*b* towards the optical axis z' as the optical axis z' extends away from front face 17 in a direction toward surface 20, as shown in FIGS. 6C and 6D (denoted by light rays 25*e* and 25*g*, respectively). Convex surface 24*b* substantially or entirely collimates light in a direction along optical axis z' (as denoted by light rays 25*f*). Concave surfaces 23*a* and 23*b* and convex surfaces 24*a* and 24*b* are also preferably symmetric. This controls the output illumination distribution of optical element 10 along the width of surface 20.

Figure 8A:
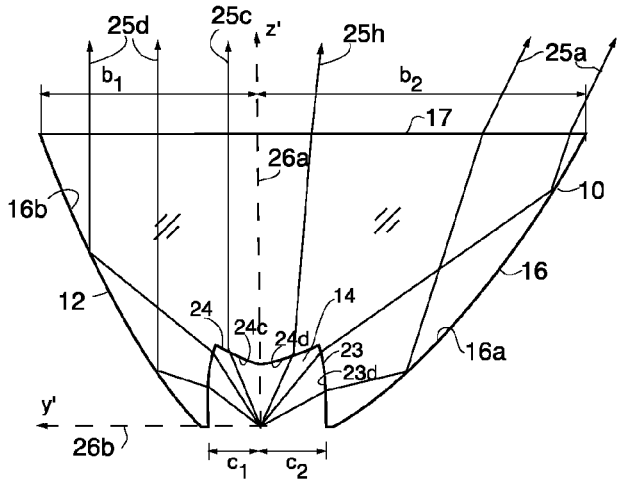
FIGS. 8A, and 8B are views similar to FIGS. 6A, and 6B, respectively, of an optical element in accordance with another example of the present invention.
Figure 8B:
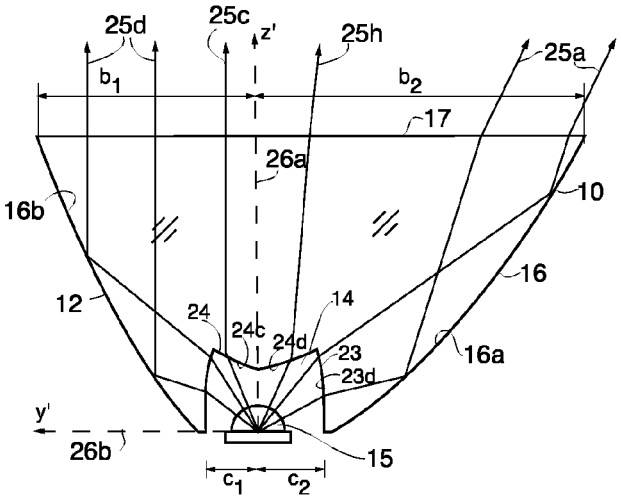
Figure 8C:
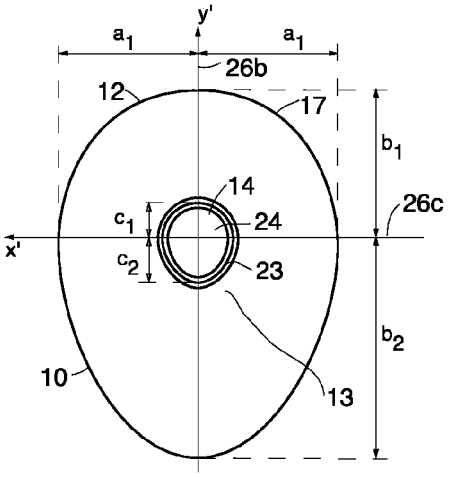
FIG. 8C is a bottom view of the optical element of FIGS. 8A and 8B.

The above example uses a cavity 14 that is rotationally symmetric about the optical axis z'. Just as the outer sides 16 are elongated to spread the light distribution down the surface of the billboard, so too can the cavity as shown in FIGS. 8A, 8B, and 8C. This example is identical to the previous example, except for central portion 24 has an upper portion (along the major axis y' above the optical axis z') having half of a convex surface 24*c* identical to the corresponding half of convex surface 24*a*, and a lower portion (along the major axis y' below the optical axis z') having a surface 24*d* with curvature that refracts light received from light source 15 away from optical axis z' as non-collimated light rays 25*h* towards the intermediate portion 20*b* of surface 20.

Figure 9:
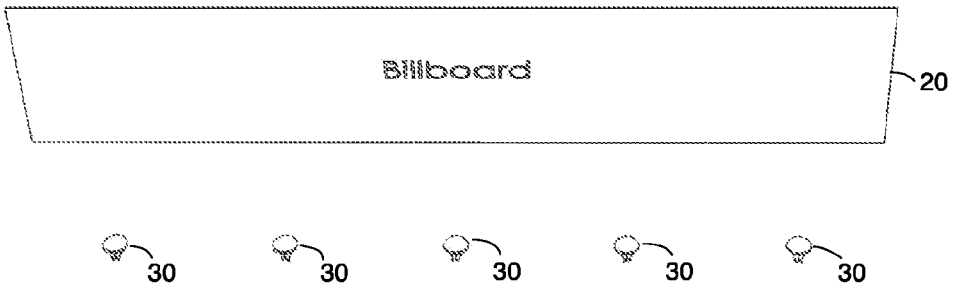
FIG. 9 is a block diagram showing an example layout of apparatuses of the present invention each having a single optical element and light source for use with same to direct oblique illumination upwards towards a surface, such as a billboard, where each of the apparatuses represent a one dimensional array of the optical elements of the present invention.
Figure 10:
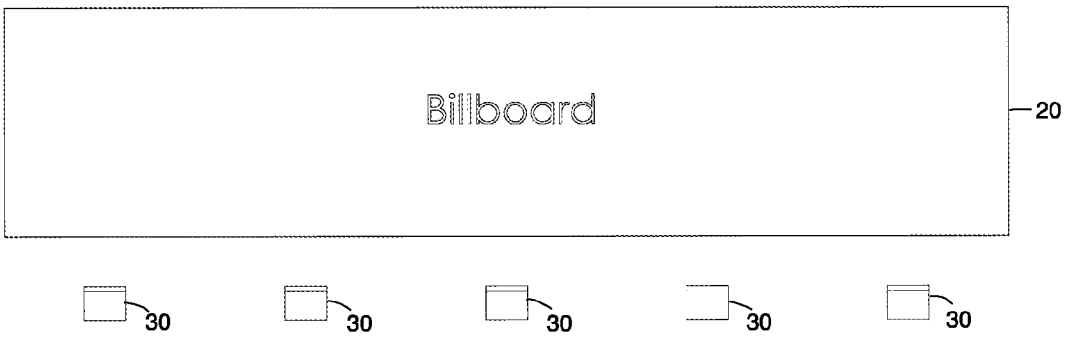
FIG. 10 is a block diagram showing a example layout of apparatuses of the present invention each having multiple optical elements and light sources to direct oblique illumination upwards towards a surface, such as a billboard.
Figure 11:
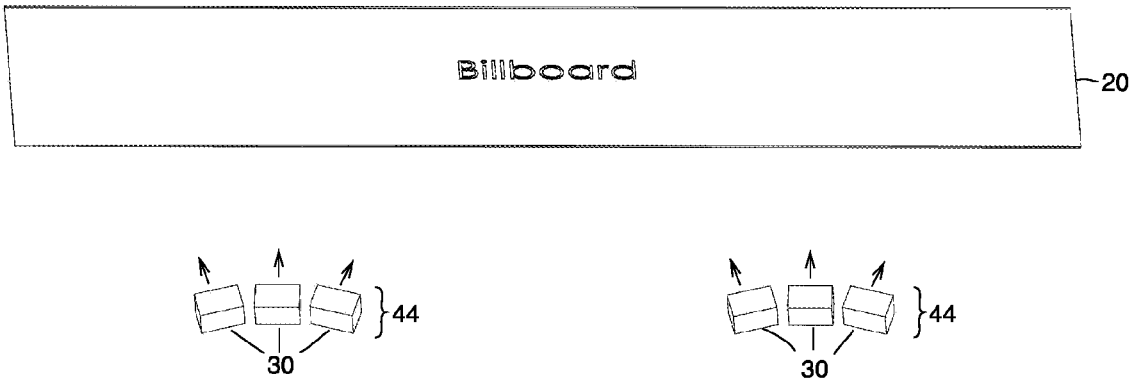
FIG. 11 is a block diagram showing an example layout of apparatuses of the present invention each having multiple optical elements and light sources to direct oblique illumination upwards towards a surface, such as a billboard, in which groups of apparatuses are disposed in banks which are separated a distance from each other.

Referring to FIGS. 9, 10, and 11, different arrays of apparatuses 30 are shown with respect to a surface 20 shown as a billboard. FIG. 9 shows a one-dimensional array of apparatuses 30 having a single optical element such as shown for example earlier in FIG. 1B. The apparatuses are evenly spaced adjacent to each other, have identical optical elements 10 and illumination sources 15, disposed the same distances 22*a* and 22*b* from surface 20, and have their respective front faces 17 tilted the same to provide oblique illumination over the viewing angles (FIG. 2). FIG. 10 shows a one-dimensional array of apparatuses 30 having multiple optical elements in one or two dimensional arrays, as shown in FIGS. 1E and 1F. The operation of optical elements 10 in such apparatus 30 may be the same as described earlier in connection with FIGS. 4A and 4B. Optionally such optical elements may be randomly oriented. The apparatuses 30 are evenly spaced adjacent to each other, have identical optical elements 10 and illumination sources 15, disposed the same distances 22*a* and 22*b* from surface 20, and have their respective front faces 17 tilted the same to provide oblique illumination over the viewing angles (FIG. 2).

FIG. 11 shows the same apparatus as shown in FIG. 10, but grouped into banks 44 evenly spaced adjacent to each other. In each bank 44 of three apparatuses 30, the center bank points directly toward the surface 20. The outer two banks on each fixture are splayed outward at different directions towards surface 20. Each points slightly outward toward the side of its bank so that banks may be spaced farther apart and still provide the desired uniformity across the surface being illuminated. The general direction of illumination along the height and width of each apparatus 30 of bank 44 are shown by arrows in FIG. 11. Optionally, each apparatus 30 in FIGS. 10 and 11 may represent multiple apparatus 30 integrated into a single fixture.

In each of FIGS. 9-11, the illumination from each adjacent apparatus 30 overlaps to at least substantially uniformly illuminate surface 20. Each single one of the apparatuses 30 of FIGS. 10 and 11 may have their optical elements operate in the same manner as described earlier in connection with FIGS. 4A and 4B, in which apparatus 30 at the ends of every two adjacent apparatuses 30 similarly overlap each other to provide uniform illumination.

Figure 12A:
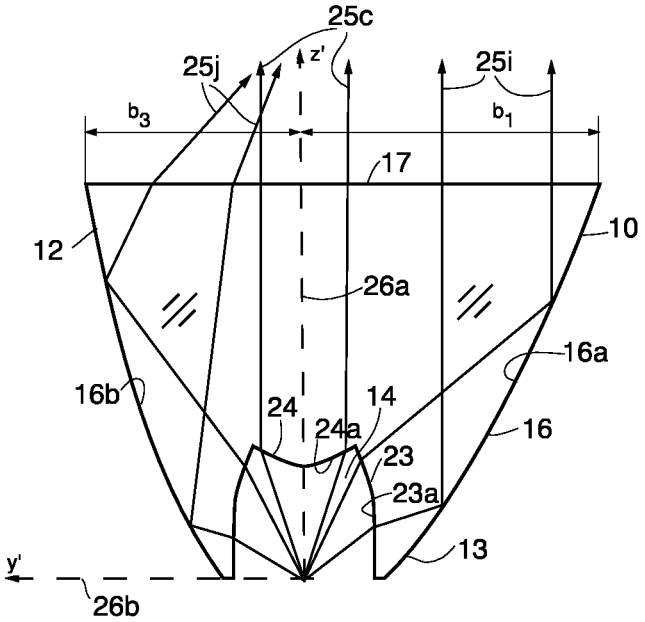
FIGS. 12A and 12B are views similar to FIGS. 6A and 6B, respectively, of an optical element in accordance with a further example of the present invention.
Figure 12B:
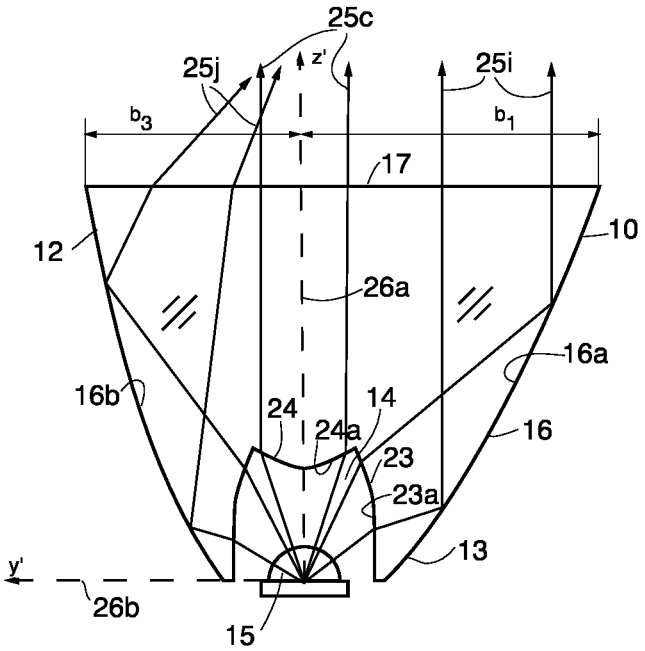
Figure 13:
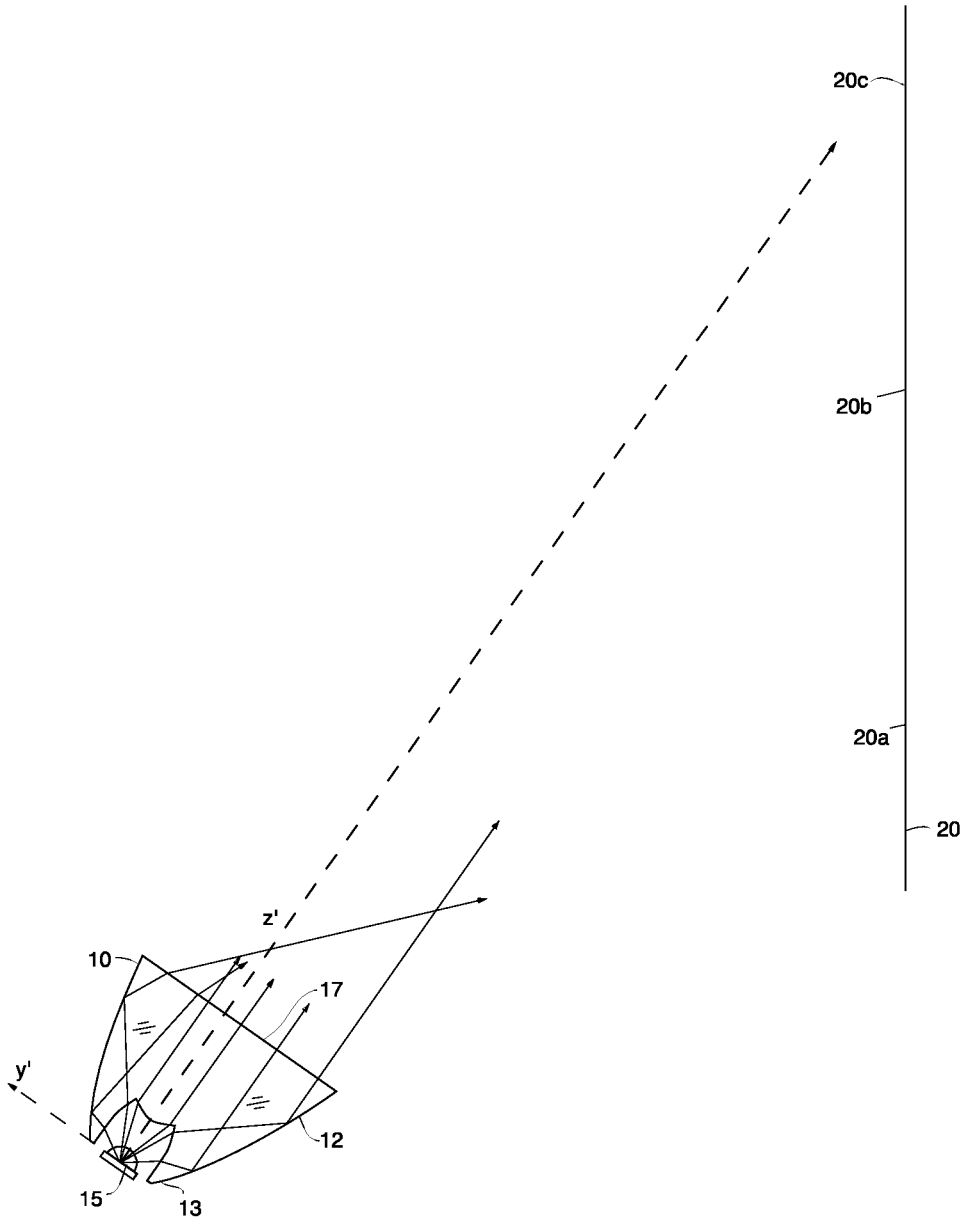
FIG. 13 is a cross-sectional view similar to FIG. 1A for the optical element of FIGS. 12A and 12B.

A further example of the optical element is shown in FIGS. 12A, 12B, and 13. The lower side 16*a* of the outer sides 16 is kept at the dimension $b_1$ and the upper dimension is at a dimension $b_3$ where $b_3$ is less than $b_1$. Keeping the lower dimension at $b_1$ means that the lower side 16*a* has surface curvature reflecting light received via side walls 23 into collimated light along the optical axis z' directed toward the upper or distal portion 20*c* of surface 20 (denoted by light rays 25*i*). Reducing $b_3$ causes the upper side 16*b* of the outer sides 16 to have surface curvature reflecting light received, via side walls 23, to be directed toward the lower or proximal portion 20*a* of surface 20 (in multiple directions denoted by light rays 25*j*). The side walls 23 and central portion 24 have surfaces the same as described earlier in FIGS. 6A-6D. This reduces the overall size of the optical element 10 from the earlier examples of FIGS. 6A-6D and 8A-8C.

Optionally, a diffusing surface or diffuser may be formed directly into front face 17 of optical element 10 to aid in spreading the light across surface 20 and homogenizing the light for a desired spatial distribution, or such diffuser may be a distinct element separated by a small distance from front face 17 to provide such function.

Certain LEDs demonstrate an angular dependence of the color (spectrum) of light that is emitted, especially in the case of "white" light sources that utilize a phosphor with a short-wavelength die to cause a broad spectrum of light to be emitted, such as for example a CREE XM-L LED. The XM-L is a white-light LED with a single phosphor-coated die, referred to herein as emitter area 15*a*, and clear encapsulating dome 15*b*. One variety of this LED is classified as cool-white with a correlated color temperature (CCT) of 5000 to 8300K.

Figure 14:
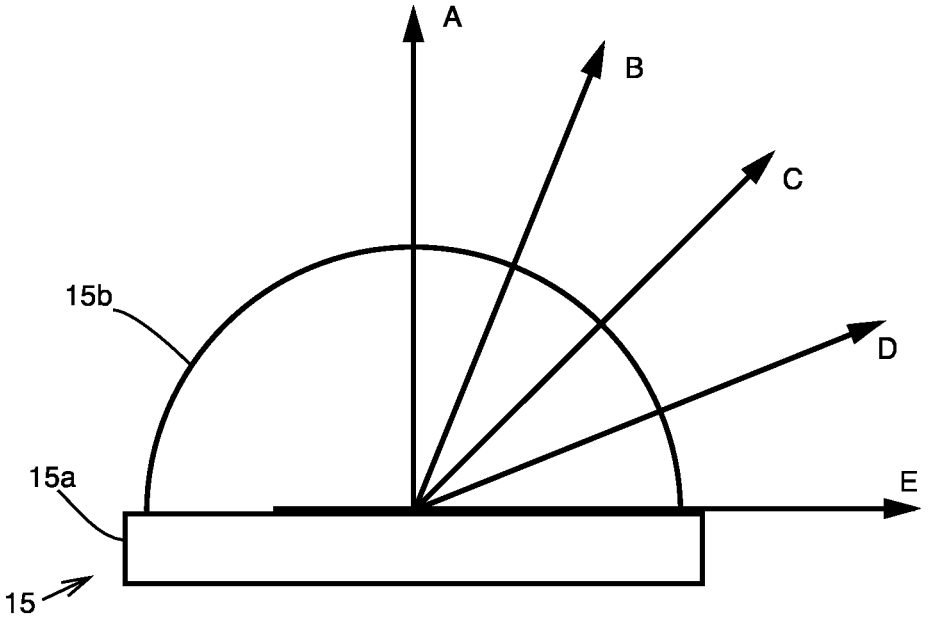
FIG. 14 is a block diagram of an LED showing five emission angles to illustrate the spectral non-uniformity of the light output.
Figure 15:
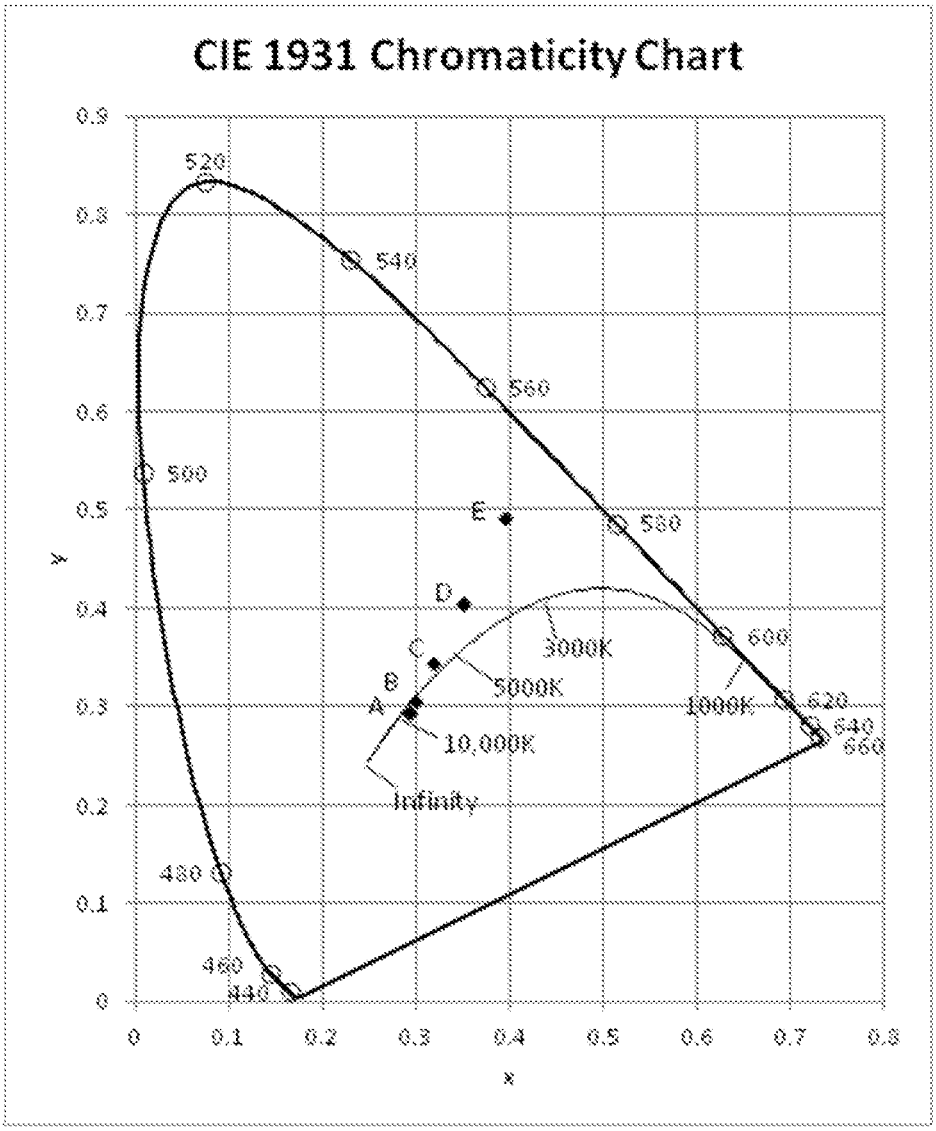
FIG. 15 is a CIE 1931 Chromaticity Chart with coordinates for a CREE XM-L cool-white LED at different angular orientations of light rays of FIG. 14 to illustrate such color shift.

Such spectral variation is dependent on the angle of the light from the emitter area 15*a* of the LED. Consider for example the LED block diagram of FIG. 14 where five emission directions are shown for light emitted from emitter area 15*a* increasing in angle from the primary or on-axis light path ray A (0°), to higher angles B, C, and D, to a furthest light path ray E (90°). In particular with the CREE XM-L cool white LED, along the primary axis ray A, the light from the LED has a CCT of 8500K. Along the light ray B at 24° from the primary axis the CCT is 7700K. For light ray C at 45° the CCT is 6100K, light ray D at 67° the CCT is 5000K, and along light ray E at 90° the CCT is 4300K. The light shifts from a cool white on axis to a pale yellow off axis. This color shift is further illustrated by plotting the chromaticity coordinates from these paths on a CIE 1931 Chromaticity Chart as shown in FIG. 15. The A, B, C, D, and E coordinates are located by the diamond markers in FIG. 15 and show a significant shift from a bluish white at A and B to increasingly more yellow for C, D, and E. For reference the blackbody color temperature curve and specific color temperature locations are also provided in FIG. 15. The open circle markers are pure wavelength locations with the corresponding wavelength in nanometers next to the markers and denote the boundary of the chromaticity space. Other LEDs from this and other manufacturers may also have a similar color shift with emission angle. This yellow color shift with angle is due to a reduction in the amount of blue light being emitted by emitter area 15*a* at higher off-axis angles.

Accordingly, an optical element 10 with an LED light source 15 that exhibits the above described color shift with emission angle, will produce a color variation in the light distribution across surface 20. In the case of vertical surface 20, such as a billboard, the light distribution on surface 20 (as depicted for example in FIGS. 4A and 4B) will have a spectral variation since the rays that illuminate the lower portion 20*a* of the surface 20, e.g., ray 25*a* and 25*b* of FIG. 1A, are emitted predominantly from the side of the LED, namely rays C, D, and E in FIG. 14. Whereas the upper portion 20*d* (i.e., portions 20*c* and 20*b*) of the surface 20 is illuminated by rays 25*c* and 25*d* and will be spectrally neutral (appearing uniform) since by the time these rays reach the surface 20 they are thoroughly mixed with each other and produce a spectrally uniform irradiance, the lower portion 20*a* is illuminated primarily by the side-emitted rays. There are fewer central rays 25*c* that propagate to the lower portion of the surface 20 to mix with these rays to homogenize the spectrum. Thus, for the case of the CREE XM-L cool white LED, for example, the lower portion 20*a* of the surface 20 will appear more yellow than the upper portion 20*d*.

Figure 17:
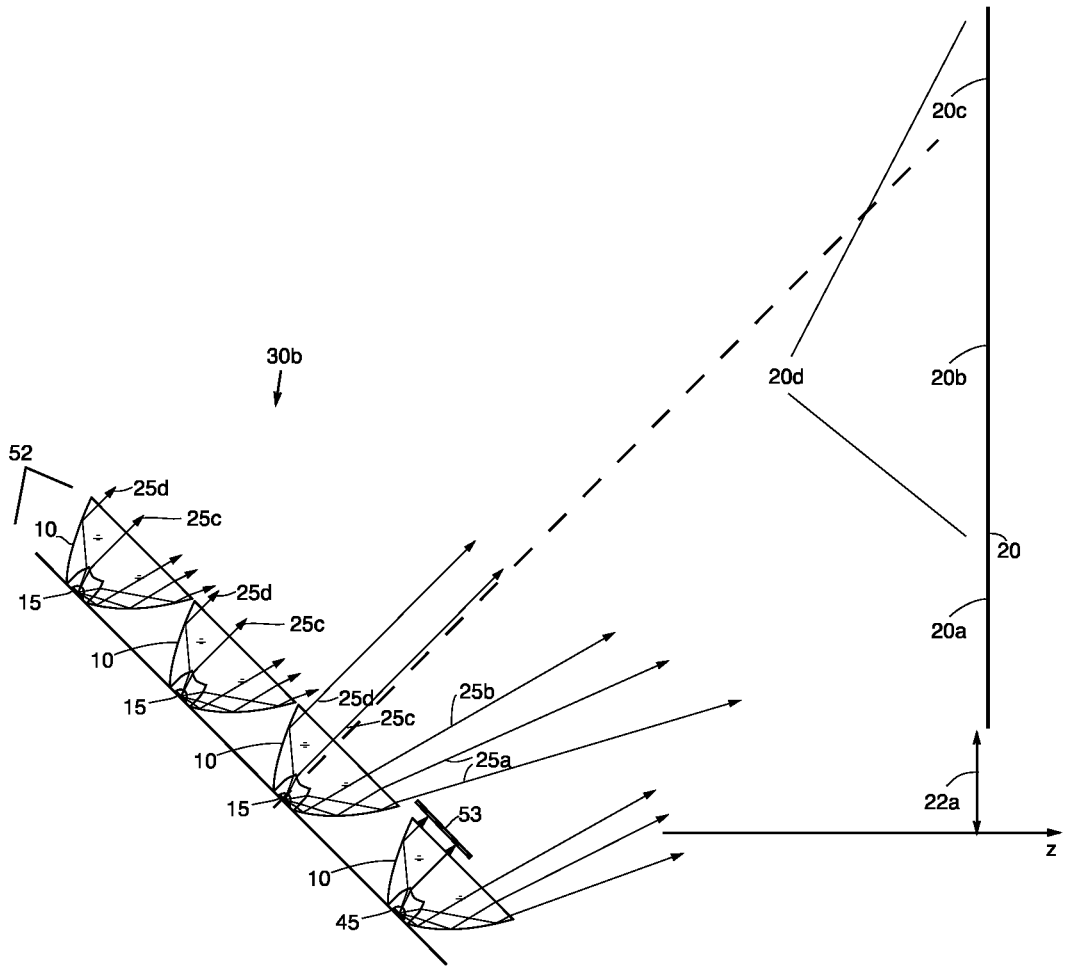
FIG. 17 is a block diagram of an apparatus having an array of optical elements of FIG. 1A for illuminating a billboard, where such optical elements utilize LED light sources exhibiting a color shift as shown in FIGS. 14 and 15, and certain optical elements of the array utilize LED light sources that correct for the spectral variation along the billboard, where such certain optical elements have light blocking or minimizing optical elements.
Figure 18:
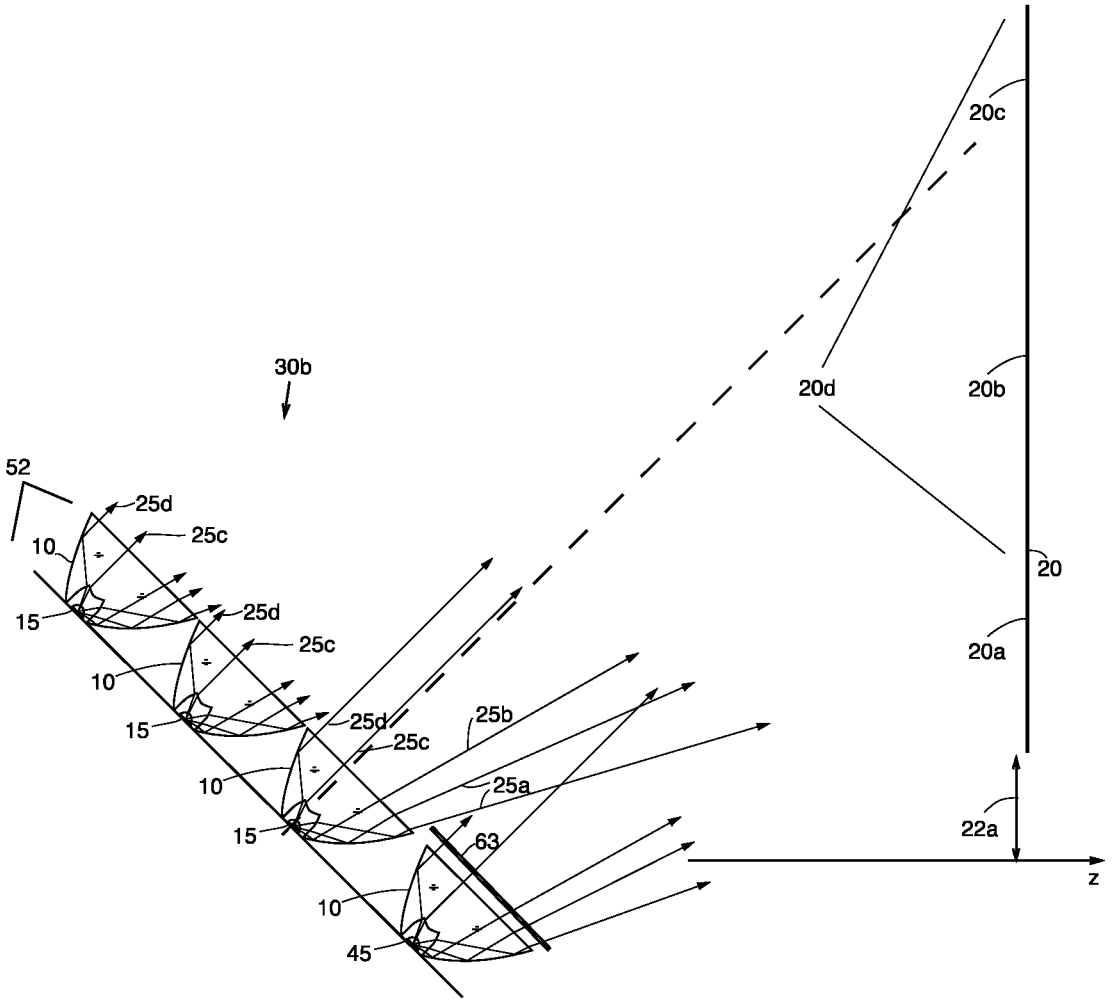
FIG. 18 is a block diagram of an apparatus having an array of optical elements of FIG. 1A for illuminating a billboard, where such optical elements utilize LED light sources exhibiting a color shift as shown in FIGS. 14 and 15, and certain optical elements of the array utilize LED light sources that correct for the spectral variation along the billboard, where such certain optical elements have light filtering optical elements.

In the case of an array of units illuminating a surface 20 as shown for example in FIGS. 4A and 4B in which each unit is an array of optical elements, such as shown for example in FIGS. 1E and 1F, this spectral variation can be corrected by adding complimentary color of blue light to the lower portion 20*a* of the surface 20, which mixes (or combined) with the yellow light emitted by optical elements 10 to be white light. For example, LED emitting light in the blue spectrum may be CREE XT-E blue LEDs. Examples of apparatus for correcting spectral variations are shown in FIGS. 16, 17 and 18.

Figure 16:
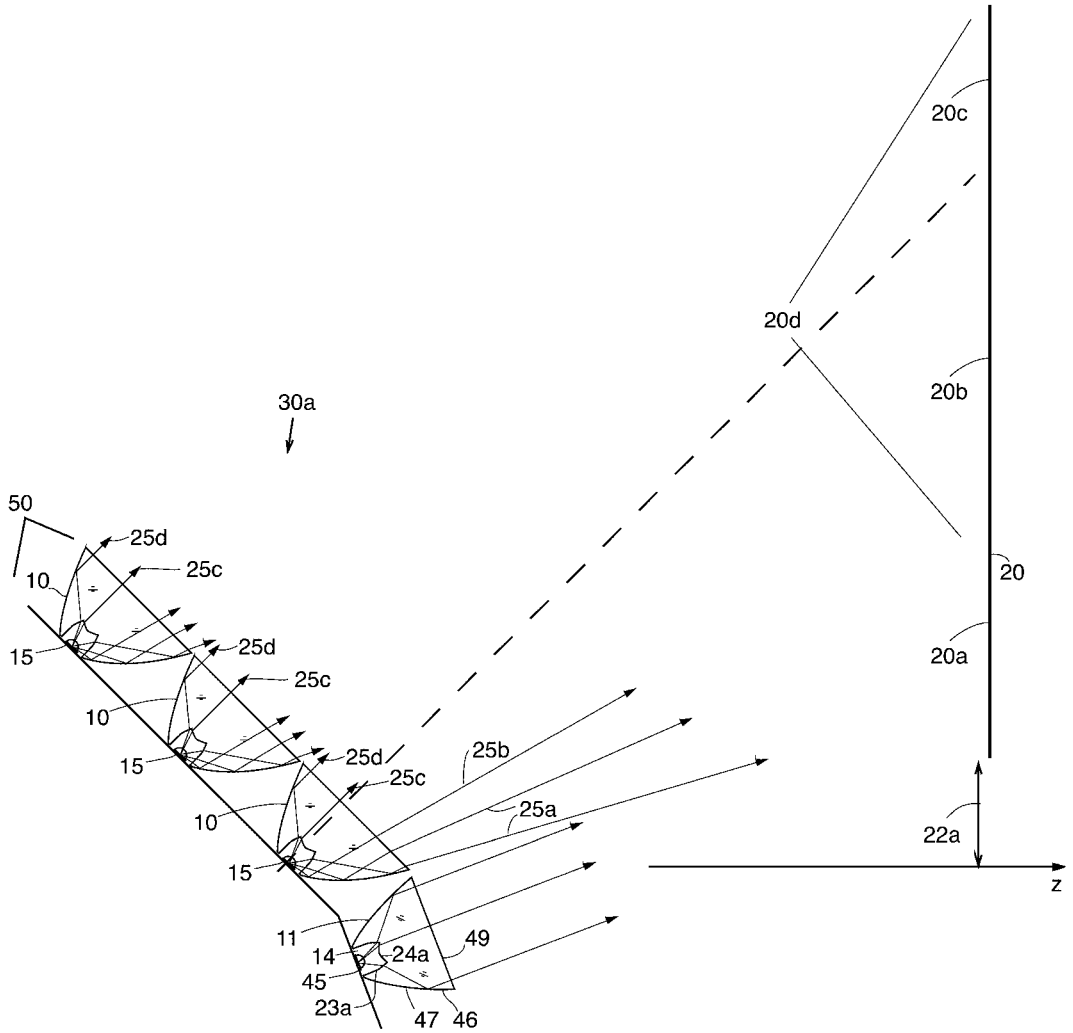
FIG. 16 is a block diagram of an apparatus having an array of optical elements of FIG. 1A for illuminating a billboard, where such optical elements utilize LED light sources exhibiting a color shift as shown in FIGS. 14 and 15, and the array has additional optical elements each with an LED light source that correct for such spectral variation where present in the billboard.

Referring to FIG. 16, an apparatus 30*a* is shown having an array 50 of first optical elements 10 and second optical elements 11. In this example, the array 50 has a column of three optical elements 10 with one optical element 11 there below. The light sources 15 of elements 10 are considered in apparatus 30*a* to be LEDs having the angular dependent color shift as described above in connection with FIGS. 14 and 15. For example LEDs 15 may be CREE LED model XM-L Cool White, but other white LEDs such as warm or neutral white may be used that demonstrate a color shift. For purpose of illustration only one column of the array 50 is illustrated showing thus a cross-section of array 50 and apparatus 30*a*. Optionally, optical elements 11 may be considered as being a separate array from array 50. The front face 17 of the first optical elements 10 is at an oblique angle with respect to surface 20, as described earlier. The size of the array 50 (columns and rows) depends on desired oblique illumination and extent of surface 20 desired to be illuminated. As described earlier, adjacent optical elements 10 may be positioned in the array 50 so their illumination overlap. One may also consider the array 50 to be an array of optical elements 10, where the bottom optical elements of the array are replaced with optical elements 11.

Optical elements 11 provide collimated blue light. Each has a rotationally symmetric body 46 having rotationally symmetric outer sides 47 providing total internal reflection, and a rotationally symmetric cavity 14 with surfaces 23*a* and 24*a* as described earlier. Positioned in cavity 14 of each optical element 11 is an LED light source 45 providing blue light. For example LED light source 45 may be a CREE LED model XT-E Royal Blue, but other blue light LEDs may be used. LED 45 may be positioned in cavity 14 associated with optical element 11 in the same manner as LED 15 with respect to body 12 of optical element 10 (and may be mounted on the same or different circuit boards). The shape of body 46 collimates the blue light from LED 45 which is then outputted from front face 49 of optical element 11, as depicted by parallel light rays emitted from optical element 11 in FIG. 16.

Optical element 11 is positioned at a tilt so as to illuminate the lower portion or area 20*a* (i.e., proximal portion to apparatus 30*a*) of the surface 20, so that front face 49 provides oblique illumination to portion 20*a*, but at a different angle than optical elements 10. The main axis of the optical elements 10 and their white light LEDs 15 remains pointed toward the upper portion 20*d* of the surface 20, while the axis of the blue LEDs 45 and optical element 11 points toward the lower portion 20*a*. In this way the light from the blue LEDs 45 mixes (or combines) with only the yellowish light produced by the white LEDs 15 of optical elements 10 onto the lower portion 20*a* of the surface 20. Thus, very little of the blue LED light from optical element 11 illuminates the upper portion 20*d* of the surface 20. The particular tilt position and direction of each optical element 11 (i.e., providing oblique illumination to portion 20*a*) is thus set or adjusted to where the non-uniform spectral illumination of LEDs 15 from one or more of optical element 10 is present on surface 20. Light from adjacently disposed optical elements 11 may partially overlap each along the width of the surface so that entire portion 20*a* of the target surface 20 along its width is uniformly illuminated (at least substantially) by optical elements 11 of array 50. Array 50 may be in a housing 32*a*, such as described earlier.

The front face 49 of optical elements 11 preferably functions as a diffusing optical element (or diffuser) to aid in spreading the light across the lower portion 20*a* of surface 20 and homogenizing the light. The diffuser of front face 49 enables the spatial distribution of the blue light from each of optical elements 11 to match (at least substantially) the spatial distribution of the white light from optical elements 10 over the lower portion 20*a* of surface 20, thus ensuring spectral uniformity along surface 20. In this manner, the appearance of spectral uniformity of combined light of optical elements 10 and 11 is enhanced or improved along portion 20*a*. For example, diffusing surface of front face 49 may have light diffusing microstructures, such as described in U.S. Pat. No. 7,033,736 (which is incorporated herein by reference), but other diffusing surfaces or diffusers may be used. Optionally, such diffuser may be a distinct element separated by a small distance from front face 49. The diffuser may not be needed if the body of the optical element 11 by its shape enables output of LED 45 light that matches (at least substantially) the spatial distribution of the white light from optical elements 10 over the lower portion 20*a* of surface 20.

The blue LED 45 has a spectrum and brightness that compensate for the variation in the original spectrum from the white LEDs described earlier in connection with FIGS. 14 and 15, and optical element 11 and its diffuser have a spatial distribution that matches and overlaps the lower spatial distribution of light of the white LEDs (e.g., rays C-E of FIG. 14) emitted from optical elements 10 so that the combination of the illumination patterns in the lower portion 20*a* of the surface 20 provides the desired spatial and spectral uniformity of white light, i.e., matching (or substantially matching) that of white LEDs 15.

Referring to FIG. 17, an apparatus 30*b* is shown having an array 52 of optical elements 10. In this example, the array 52 has a column of four optical elements 10. For purpose of illustration only one column of the array 52 is illustrated showing thus a cross-section of array 52 and apparatus 30*b*. The size of the array (columns and rows) depends on desired oblique illumination and extent of surface 20. As described earlier, adjacent optical elements 10 may be positioned in the array 52 so their illumination overlap. The bottom row of optical elements 10 are considered to be second optical elements having their light sources 15 replaced by a blue light LEDs 45, while the other optical elements 10 in the array 52 are considered to be first optical elements having LEDs 15 demonstrating the angular dependent color shift described earlier in connection with FIGS. 14 and 15. In other words, the body 12 of all optical elements either having white or blue LEDs in array 52 are the same. Thus, one may consider array 52 being the same as arrays of optical elements described earlier in which the bottom most optical element(s) 10 each have blue light LED 45, rather than a white light LED 15. Array 52 may be in a housing 32*a*, such as described earlier.

The front face 17 of optical elements 10 of array 52 are disposed at an oblique angle with respect to surface 20, such as described earlier. In this case the axis of the blue LED 45 optical elements still points toward the uppermost portion 20*c* of the surface 20 like the white LEDs 15 optical elements, but an optical element 53 providing a light block or aperture is placed over the upper part of each of the optical elements 10 having blue light LEDs 45 to prevent (or at least minimize) the blue LED light from illuminating the upper portion 20*d* of the surface 20. The blue light from the lower part of the blue light LED optical elements 10 propagates to the lower portion 20*a* of surface 20. Thus, optical element 53 is of a size and shape to cover the extent of front face 17 of its respective optical element 10 with LED 45 as needed along the upper portion thereof to block or at least minimize (or limit) light that would otherwise illuminate portion 20*d* of surface 20 that by definition does not need any blue light from LED 45 to be spectral uniform. Optical element 53 may enable upper portion 20*d* to receive some blue light which mixes or combines with other LED 15 light falling thereupon without affecting its spectral uniform appearance. In this way the spatial distribution of the blue light on the lower portion 20*a* of the surface 20 matches the distribution of white light LEDs 15 of other of optical element 10 in the same portion 20*a* of the surface 20. The brightness and spectrum of the blue LED are chosen to compensate the non-uniform spectrum of the white LEDs and maintain the spatial uniformity of the light irradiance across the entire area of surface 20. Optical elements 10 with LEDs 15 or 45 in FIG. 17 may have the optional diffusing surface or diffuser, as described earlier, for optical elements 10. Such diffusing surface may not be needed where optical element 53 is present along front face 17.

The above examples solve the problem of spectral non-uniformity through the addition of one or more LEDs 45 or other light sources, providing blue light. The spectral non-uniformity described earlier may also be corrected by other means, such as shown for example in FIG. 18 in the case of array 52, by addition of an optical element 63 providing spectrally filtering that is incorporated into, onto or spaced from front face 17 of one or more optical elements 10 with light sources 45 that block or filter the light emitted by of their light sources as a function of the angle of emission from the one or more light sources 15. Optical elements 63 thus enable blue LED light from the lower portion of the blue light LED optical elements 10 to propagate to the lower portion 20*a* of surface 20, while preventing or at least minimizing (or limit) light from the upper portion of the blue light LED optical elements that would otherwise illuminate upper portion 20*d* of surface 20. Optical elements 63 may enable upper portion 20*d* to receive some blue light without effecting the spectral uniform appearance of portion 20*d*. Optionally, optical elements 63 may vary filtering of blue light passing therethrough, i.e., increasing the spectral filtering of blue light to surface 20 as color on surface 20 changes between yellowiest (at lowest part of portion 20*a*) to whitest (at interface of portions 20*a* and 20*d* on surface 20).

While FIGS. 16-18 show the blue LED 45 and associated optical element 10 or 11 are shown positioned at the bottom of the array 51 or 52, this is for illustration only. Optical elements with blue LEDs 45 can be positioned anywhere within array 51 or 52 and perform the same function.

In general, optical elements with blue light LEDs 45 for illuminating a target surface are provided with an optical spectrum that compensates for the non-uniformity of light from optical elements with white light LEDs 15 that illuminate that target surface. Thus LEDs 45 provide illumination which are spectrally common in color to compensate for the spectral non-uniformity of LEDs 15. The examples of FIGS. 16-18 relate to providing more uniform spectral illumination across the surface 20 in the case of a billboard by addition of a blue LED to correct for a yellow color shift with angle. However, it is appreciated that the invention extends to other color corrections for other portions of the optical spectrum on billboards or other obliquely illuminated target surfaces. For example, it is possible that LED 15 may have different spectral regions of spectral non-uniformity, such as in the red and blue spectral regions. To correct this, multiple different types of LEDs 45 are utilized in which each different type is associated with a different color, and each different color corrects a different spectral region of non-uniformity of LEDs 15. In this case, different groups of one or more optical elements 10 or 11 with LEDs 45 are provided in array 50 or 52, where each group has LEDs 45 providing illumination of different color to same portion 20*a* (or different portions) of surface 20 exhibiting light deficiency of that color. Thus if one region (or portion) of a target surface is lacking, for example, in the red portion of the spectrum compared to the rest of the target surface to be obliquely illuminated, then one or more red LEDs can be used to illuminate just that region (or portion) with a sufficient amount of red light to compensate for the deficiency and produce a more uniform spectral distribution across the entire target surface of desired color light while still maintaining the desired uniformity in irradiance. Each LED 45 of each group produces a single desired color of illumination. However, an LED 45 may be of a type that provide different colors of illumination, rather than only one. For example, an LED 45 may have four different color dies of red, green, blue, and white, such as a CREE Xlamp XM-L Color LED. The LED 45 is then controlled to output illumination of one or more of its four colors red, green, blue, and white as desired. Although the above applications relate to billboard illumination, any vertical surface requiring oblique illumination can utilize the optical elements 10 and apparatuses 30, 30*a*, or 30*b* where avoiding obstructing the view from the front thereof is desired, such as to illuminate paintings disposed along a wall, to illuminate walls or ceilings of a room, or for architectural illumination. Further, optical elements 10 and apparatuses 30, 30*a* and 30*b* may be disposed below spaced from the front of surface 20 for upwards oblique illumination, as shown in the figures, but may be disposed in other orientations, such as above and spaced from the top of surface 20 for downwards oblique illumination, or along a side edge for sideways oblique illumination.

From the foregoing description, it will be apparent that an optical element providing at least substantially uniform oblique illumination and apparatuses and methods using same have been provided. Although preferably light sources of these optical elements do not demonstrate angular dependent color shift, apparatuses and methods addressing such problem have been provided. Variations and modifications of the herein described optical elements, systems, apparatuses, and methods and other applications for the invention will undoubtedly suggest themselves to those skilled in the art. Accordingly, the foregoing description should be taken as illustrative and not in a limiting sense.

The invention claimed is:

1. An apparatus for providing illumination to a surface at an oblique angle comprising:

a plurality of first optical elements each have a first body, a first light source providing a first illumination of a first color to said first body, and a first front face of said first body disposed at an oblique angle with respect to a target surface, in which said first illumination is spectrally non-uniform from said first color along a portion of the target surface; and a plurality of second optical elements each having a second body, a second light source providing second illumination to said second body of a different color than said first color to compensate for the spectral non-uniformity of the first light source, and a second front face of said second body disposed at an oblique angle with respect to the target surface, in which said second body directs said second illumination to said portion and said second illumination combines said first illumination to provide along said portion combined illumination that is spectrally uniform of said first color.

2. The apparatus according to claim 1 wherein said first light source is disposed to provide light to said first body over an angular range, and said first illumination from said first light source is spectrally non-uniform along part of its angular range.

3. The apparatus according to claim 1 wherein said first light source has an optical axis centrally disposed along said angular range, in which first illumination from said first light source along said part of said angular range increases with spectral non-uniformity at increasing off-axis angles from said optical axis, and said portion of the target surface receive the off-axis light of the first light source from different ones of first optical elements that substantially avoids mixing with light of other different ones of said first optical elements.

4. The apparatus according to claim 3 wherein said first illumination along said angular range from different ones of said first optical elements mix along other portions than said portion at least substantially spectrally uniform of said first color.

5. The apparatus according to claim 1 wherein said portion of the target surface is a bottom portion of the target surface.

6. The apparatus according to claim 1 wherein said second light source of said second optical elements provides said second illumination to the second body which are spectrally common in said second color to compensate for the spectral non-uniformity of the first light source.

7. The apparatus according to claim 1 wherein said second color of the second illumination of one or more of said second optical elements are of one or more different colors than said first color to compensate for the different regions of spectral non-uniformity of the first light source along said portion or different portions of said target surface.

8. The apparatus according to claim 1 wherein said first optical elements provide said first illumination to said target surface that is at least substantially uniform in irradiance over said target surface.

9. The apparatus according to claim 1 wherein said first body of each of said first optical elements is asymmetrically shaped extending to provide said first illumination along the height of the target surface and along at least a portion of the width of the target surface in which said first illumination from said first body has increased intensity with increasing height along said target surface to provide at least substantially uniform illumination of the first light source upon said target surface along at least said height of said target surface.

10. The apparatus according to claim 1 wherein said second body each of said second optical elements is asymmetrically shaped to provide said second illumination extending along the height of the target surface and along at least a portion of the width of the target surface, and said second optical element each further comprise an optical element for preventing or at least minimizing light from the second light source provided by the second body towards other portion of said target surface than said portion.

11. The apparatus according to claim 1 wherein said second body each of said second optical elements is asymmetrically shaped to provide said second illumination extending along the height of the target surface and along at least a portion of the width of the target surface, and said second optical elements each further comprise an optical element for spectrally filtering light from the second light source provided by the second body towards from other portion of said target surface than said portion.

12. The apparatus according to claim 1 wherein second body of said second optical elements is rotationally symmetric to provide collimated said second illumination light to said one or more portions of said target surface.

13. The apparatus according to claim 1 wherein each of said second optical elements further comprises an optical element for making spatial distribution of said second illumination at least substantially match the spatial distribution of said first illumination over said portion of the target surface.

14. The apparatus according to claim 1 wherein said first and second optical elements are each disposed in a unit and said first illumination is provided to said target surface along at least a portion of the width of said target surface.

15. The apparatus according to claim 1 wherein said first and second light sources are each LEDs.

16. The apparatus according to claim 1 wherein said first color is white and said second color is blue.

17. The apparatus according to claim 1 wherein said target surface is a billboard sign.

18. An apparatus for providing illumination to a surface at an oblique angle comprising:

at least one first optical element having:

a first body;

a first light source having an optical axis and providing a first illumination of a first color to said first body over an angular range centered about said optical axis, and said first illumination increases in spectral non-uniformity with increasing angles away from said optical axis in said angular range; and a first front face of said first body disposed at an oblique angle with respect to a target surface to provide said first illumination upon said target surface in which a portion of said target surface having first illumination that is spectrally non-uniform appears different in color than said first color; and at least one second optical element having a second body;

a second light source providing second illumination to said second body of a second color different than said first color; and a second front face of said second body disposed at an oblique angle with respect to the target surface, in which said second body provides said second illumination to said portion of said target surface, and said second illumination combines said first illumination along said portion to provide combined first and second illumination that appears spectrally uniform with said first color.

19. The apparatus according to claim 18 wherein said second illumination of said second color is along one or more spectral regions.

20. The apparatus according to claim 18 wherein said first body is asymmetrically shaped to direct light from the first light source along a height of said target surface to provide at least substantially uniform illumination of said light of said first light source upon said target surface along at least said height of said target surface, and provides at least substantially spectrally uniform in said first color along said least said height of said target surface to other portion of said target surface than said portion of said target surface.

21. The apparatus according to claim 18 wherein said plurality of said first optical element and said plurality of said second optical element form a one or two-dimensional array.

22. The apparatus according to claim 18 wherein said second body of said second optical element is asymmetrically shaped to provide said second illumination extending along the height of the target surface and along at least a portion of the width of the target surface, and said second optical element further comprises means for limiting the amount of light of said second color provided by the second body towards other portion of said target surface than said portion.

23. The apparatus according to claim 18 wherein second body of said optical elements is rotationally symmetric to provide collimated said second illumination light to said portion of said target surface.

24. The apparatus according to claim 18 wherein said second optical element further comprises a diffuser for making spatial distribution of said second illumination at least substantially match the spatial distribution of said first illumination to enhance appearance of spectral uniformity of said combined first and second illumination along said portion of said target surface.

25. The apparatus according to claim 18 further comprising a one or two-dimensional array of a plurality of ones of said first optical element and a plurality of ones of said second optical element.

26. The apparatus according to claim 18 further comprising:

a plurality of ones of said second optical element, wherein said spectral non-uniformity of said first light source is in multiple different spectral regions; and said plurality of ones of said second optical element provide second illumination of said second color from their respective said second light source in each of said multiple different spectral regions to said portion or different portion of said target surface to enable said target surface to appear spectrally uniform.

27. A method for providing illumination to a surface at an oblique angle comprising the steps of:

illuminating a target surface with at least one first optical element having a first body, a first light source having an optical axis and providing a first illumination of a first color to said first body over an angular range centered about said optical axis, and said first illumination increases in spectral non-uniformity with increasing angles away from said optical axis in said angular range;

positioning a first front face of said first body disposed at an oblique angle with respect to a target surface to direct said first illumination upon said target surface in which a portion of said target surface having first illumination that is spectrally non-uniform appears different in color than said first color;

illuminating a target surface with at least one second optical element having a second body, a second light source providing second illumination to said second body of a second color different than said first color;

positioning a second front face of said second body disposed at an oblique angle with respect to the target surface to direct said second illumination to said portion of said target surface; and combining said second illumination and said first illumination along said portion to provide combined first and second illumination that appears spectrally uniform with said a first color.

28. An illumination system comprising:

one or more first optical elements providing light that illuminates a surface in which a part of said surface receives illumination from said one or more first optical elements that has substantial spectral non-uniformity, wherein each of said one or more first optical elements comprises a body having a front face with a smoothly continuous planar curved outer edge, and a cavity for receiving light from a light source, wherein said body is asymmetrically shaped oblong at least at said front face; and one or more second optical elements providing light in one or more spectral ranges for illuminating said part of said surface when illuminated by said one or more first optical elements to enable said part of the surface to appear spectrally uniform with another part of said surface illuminated by said one or more first optical elements.

29. The illumination system according to claim 28 wherein said front face of said body is disposed at an oblique angle with respect to said surface.

30. The illumination system according to claim 29 wherein said body outputs illumination from said front face upon the surface extending along a first dimension of the surface and along at least a portion of a second dimension of the surface orthogonal to said first dimension of the surface in which said illumination from said body has increased intensity with increasing distance from the surface along said first dimension of the surface to provide at least substantially uniform illumination of said surface along at least said first dimension of said surface.

* * * * *